US007662530B2

(12) United States Patent
Iimura

(10) Patent No.: US 7,662,530 B2
(45) Date of Patent: Feb. 16, 2010

(54) IMAGE FORMING APPARATUS AND IMAGE FORMING METHOD

(75) Inventor: Haruo Iimura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 455 days.

(21) Appl. No.: 11/425,887

(22) Filed: Jun. 22, 2006

(65) Prior Publication Data

US 2006/0292470 A1 Dec. 28, 2006

(30) Foreign Application Priority Data

Jun. 24, 2005 (JP) ..... 2005-184955

(51) Int. Cl.
*G03G 9/00* (2006.01)
*G03G 13/16* (2006.01)

(52) U.S. Cl. ..... 430/108.1; 430/110.1; 430/111.4; 430/125.3; 399/252

(58) Field of Classification Search ..... 430/108.1, 430/110.1, 111.4, 125.3; 399/252
See application file for complete search history.

(56) References Cited

U.S. PATENT DOCUMENTS 6,284,424 B1 9/2001 Iimura et al.
6,500,594 B2 * 12/2002 Hamano et al. ..... 430/109.4

FOREIGN PATENT DOCUMENTS

| | | |
|---|---|---|
| JP | 2000-66441 | 3/2000 |
| JP | 2001-83735 | 3/2001 |
| JP | 2001-255677 | 9/2001 |
| JP | 2001-318485 | 11/2001 |
| JP | 2002-311638 | 10/2002 |

* cited by examiner

*Primary Examiner*—Mark A Chapman
(74) *Attorney, Agent, or Firm*—Oblon, Spivak, McClelland, Maier & Neustadt, L.L.P.

(57) ABSTRACT

Provided is an image forming apparatus containing a latent electrostatic image bearing member, a latent electrostatic image forming unit configured to form a latent electrostatic image on the latent electrostatic image bearing member, a developing unit configured to develop the latent electrostatic image using a toner to form a toner image, and a transferring unit configured to transfer the toner image on a recording medium, wherein a surface of the toner is coated with an external additive containing fine particles having an average particle diameter Da of 100 nm to 300 nm, and a value obtained by dividing an average F of non-electrostatic adhesion between the toner and the latent electrostatic image bearing member by a product of volume average particle diameter of the toner Dt and average particle diameter of the external additive Da, [F/(Dt×Da)] is $7.5\times10^4$ N/m$^2$ or less.

16 Claims, 4 Drawing Sheets

IMAGE FORMING APPARATUS AND IMAGE FORMING METHOD

BACKGROUND OF THE INVENTION

1. Field of the Invention

The present invention relates to an image forming apparatus and an image forming method used for copiers, electrostatic printings, printers and electrostatic recordings.

2. Description of the Related Art

Various electrophotographic methods have been known and in general, a surface of a latent electrostatic image bearing member is charged and the charged surface of the latent electrostatic image bearing member is exposed to form a latent electrostatic image. And the latent electrostatic image is developed using a toner to form a toner image on the latent electrostatic image bearing member. Moreover, the toner image on the latent electrostatic image bearing member is transferred to a recording medium directly or through an intermediate transfer member and a record on which an image is formed on the recording medium is obtained by fixing the transferred toner image by application of heat, pressure or both at the same time. Meanwhile, the residual toner on the latent electrostatic image bearing member after toner image transferring is cleaned by known methods using blade, brush, roller, and the like.

Better image quality, digitalization, colorization and speeding-up are demanded as a trend of electrophotographic technologies nowadays. For example, high resolution of 1,200 dpi or more is being investigated and image forming methods of high resolution which is previously unheard of are demanded in order to realize the high resolution of 1,200 dpi or more. More reduction in particle diameters of toner and developer for visualizing the latent electrostatic images are also examined in order to form high-resolution images and it is in the process of being realized.

Moreover, uniformity of dots which form the images is required for corresponding to digitalization of the images and uniformity of toner which forms the dots is also required. For this reason, a pulverization toner which is granulated by thermal current granulation and current granulation or a spherical toner such as polymerized toner produced by suspension polymerization, emulsion polymerization and dispersion polymerization are advantageous over commonly used pulverized toners having nonuniform profile produced by mechanical pulverization.

Furthermore, a tandem type electrophotograhic technique, in which each toner image formed on the latent electrostatic image bearing member respectively is transferred to a recording medium directly or through an intermediate transfer member using a number of latent electrostatic image bearing members and developing units, is employed for speeding up of color image output. However, in order to correspond to further speeding up of image output, the roller used for developing must be rotated at a high velocity to substantially increase the developed amount per unit of time.

In this case, a layer thickness of toner on the developing roller is regulated by control member in single component development and the toner on the developing roller is mechanically stressed from stirring with carriers or height regulation of magnetic brush, etc. in two-component development, and the stress received by the toner is further increased by high rotation frequency of the developing roller. Consequently, the toner surface is coated with fine particles (external additives) for ensuring flowability, however, the mechanical stress has an impact on the toner and causes burial and separation, etc. of external additives. By this burial and separation of external additives, adhesion between toner and other members and between toners are increased and problems such as degradation of transfer ratio and increased probability of "hollow defects" occurrence, a defect in which a part of an image, especially the center part of thin lines is not transferred, arises. For this reason, measures such as reducing the mechanical stress, etc. are employed to prevent burial or separation of external additives, however, sufficient effect has not been obtained.

It is proposed in Japanese Patent Application Laid-Open (JP-A) Nos. 2001-83735 and 2002-311638 that by using external additives of large particle diameters, which are unlikely to be buried in the toner, the increase in toner adhesion due to mechanical stress can be prevented.

Furthermore, "hollow defects" phenomenon during transferring is thought to occur because adhesion of the toner compressed with a pressure between an image bearing member and a transfer member, particularly the non-electrostatic adhesion independent from the charge of the toner increases, making the toner transfer uncontrollable by Coulomb's force of electrical field. For example, intensity range of non-electrostatic adhesion is defined in JP-A No. 2000-66441. Moreover, in JP-A Nos. 2001-318485 and 2001-255677, the range of dependence property of non-electrostatic adhesion on the toner particle diameter is defined to prevent "hollow defects".

However, non-electrostatic adhesion is dependent on the particle diameter of external additives and the relation between non-electrostatic adhesion and particle diameter of external additives is not defined at all in the prior art documents and the relation between non-electrostatic adhesion when external additives of large particle diameters are used, and "hollow defects" is not being investigated satisfactorily.

Therefore, prompt provision of the image forming apparatus and the image forming method, which are capable of obtaining appropriate images stably even after long-term use with high transfer efficiency and no image defects such as "hollow defects", is desired under the current circumstances.

SUMMARY OF THE INVENTION

It is an object of the present invention to provide an image forming apparatus and an image forming method which are capable of obtaining appropriate images stably even after long-term use with high transfer efficiency and no image defects such as "hollow defects".

An image forming apparatus containing a latent electrostatic image bearing member, a latent electrostatic image forming unit configured to form a latent electrostatic image on the latent electrostatic image bearing member, a developing unit configured to develop the latent electrostatic image using a toner to form a toner image; and a transferring unit configured to transfer the toner image on a recording medium, wherein a surface of the toner is coated with an external additive containing fine particles having an average particle diameter Da of 100 nm to 300 nm, and a value obtained by dividing an average F of non-electrostatic adhesion between the toner and the latent electrostatic image bearing member by a product of volume average particle diameter of the toner Dt and average particle diameter of the external additive Da, [F/(Dt×Da)] is $7.5\times10^4$ N/m$^2$ or less. In the image forming apparatus of the present invention, a toner is coated with external additives of large particle diameters and the value obtained from F/(Dt×Da), where F represents non-electrostatic adhesion of the toner, Dt represents toner particle diameter and Da represents particle diameter of external additives, is within an appropriate range, thereby exhibiting high transfer efficiency and no image defects such as "hollow defects", making it possible to obtain appropriate images stably even after long-term use.

An image forming method containing forming a latent electrostatic image on the latent electrostatic image bearing member, developing the latent electrostatic image using a toner to form a toner image, and transferring the toner image to a recording medium, wherein a surface of the toner is coated with an external additive containing fine particles having an average particle diameter Da of 100 nm to 300 nm, and a value obtained by dividing an average F of non-electrostatic adhesion between the toner and the latent electrostatic image bearing member by a product of volume average particle diameter of the toner Dt and average particle diameter of the external additive Da, [F/(Dt×Da)] is $7.5\times10^4$ N/m$^2$ or less. In the image forming method of the present invention, a toner is coated with external additives of large particle diameters and the value obtained from F/(Dt×Da) where F represents non-electrostatic adhesion of the toner, Dt represents toner particle diameter and Da represents particle diameter of external additives is within an appropriate range, thereby exhibiting high transfer efficiency and no image defects such as "hollow defects", making it possible to obtain appropriate images stably even after long-term use.

DESCRIPTION OF THE PREFERRED EMBODIMENTS

Figure 1:
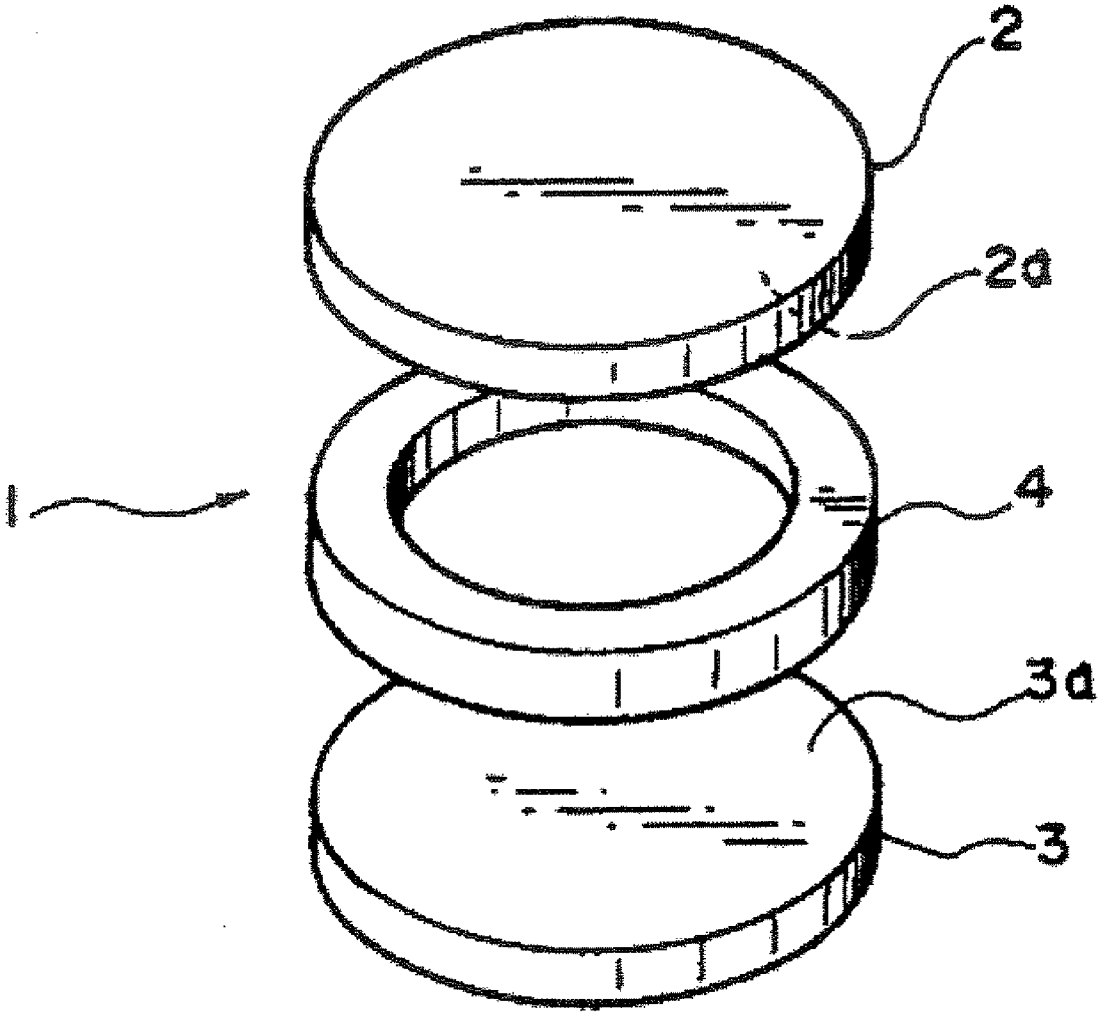
FIG. 1 is an explanatory diagram of a measurement cell in the powder adhesion measurement apparatus of the present invention.

Image Forming Method and Image Forming Apparatus

The image forming apparatus of the present invention at least contains a latent electrostatic image bearing member, latent electrostatic image forming unit, developing unit and transferring unit and further contains other units as necessary and examples include fixing unit, charge removing unit, cleaning unit, recycling unit and control unit.

The image forming method of the present invention at least contains latent electrostatic image forming, developing and transferring and further contains other steps as necessary and examples include fixing, charge removing, cleaning, recycling and controlling.

The image forming apparatus is preferably a tandem type in which image forming elements, containing at least the latent electrostatic image bearing member, latent electrostatic image forming unit, developing unit and transferring unit, are arranged in plural numbers. Since this tandem type is equipped with image forming elements for yellow, magenta, cyan and black and each toner image is prepared in parallel with four image forming elements and lapped over a recording medium (transfer paper) or intermediate transfer member, it is possible to form color images at high speed.

The image forming method of the present invention can be favorably performed by the image forming apparatus of the present invention, the latent electrostatic image forming can be performed by the latent electrostatic image forming unit, the developing can be performed by the developing unit, the transferring can be performed by the transferring unit and the other steps can be performed by the other units.

—Latent Electrostatic Image Forming and Latent Electrostatic Image Forming Unit—

The latent electrostatic image forming is a step to form a latent electrostatic image on a latent electrostatic image bearing member.

<Latent Electrostatic Image Bearing Member>

The latent electrostatic image bearing member (herein after, may be referred to as "photoconductor" and "electrophotographic photoconductor") contains support and at least photosensitive layer on the support and further contains other layers as necessary.

The surface irregularity of the photoconductor is generated by the effects of surface nature of the support or forming condition of photoconductors. Furthermore, the toner is attached on the photoconductor, and adhesion between the toner and photoconductor generates during developing. However, if the irregularity cycle of the photoconductor is approximately equal to the toner particle diameter, adhesion is weakened because of the small contact area when the toner comes in contact with convex part. If the toner comes into contact with concave part, adhesion is strengthened due to large contact area resulting in wide variation in adhesion. Furthermore, if adhesion varies widely between toner and photoconductor, transfer property of the toner varies widely during transferring and graininess is degraded. Moreover, if irregularity cycle of the photoconductor is satisfactorily larger than the toner particle diameter or smaller than the toner particle diameter, variation in adhesion between the toner and photoconductor is less as compared to adhesion when frequency of irregularity of the photoconductor is equal to the toner particle diameter. However, it is difficult to form irregularity of the photoconductor with irregularity cycle being smaller than the toner particle diameter. Therefore, an average cycle of surface irregularity of the photoconductor, Sm is preferably larger than the volume average particle diameter of the toner, Dt satisfactorily and it is more preferably satisfying $Sm \geqq 10Dt$ and most preferably satisfying $Sm \geqq 20Dt$.

The first embodiment of the latent electrostatic image bearing member contains a support, a single-layer photosensitive layer on the support and further contains protective layers, intermediate layers and other layers as necessary.

Furthermore, the second embodiment of the latent electrostatic image bearing member contains a support and a multilayer photosensitive layer at least containing a charge generating layer and a charge transport layer in this order on the support, and further contains protective layers, intermediate layers and other layers as necessary. Meanwhile, in the second embodiment, charge generating layer and the charge transport layer can be laminated reversely.

—Support—

The support is not particularly limited as long as it exhibits electrical conductivity of volume resistance of $10^{10}$ Ω·cm or less and may be selected accordingly. Examples include metals such as aluminum, nickel, chrome, nichrome, copper, gold, silver and platinum; metal oxides such as tin oxide and indium oxide which are applied to film or tube like plastics or paper by vacuum evaporation or sputtering; plates of aluminum, aluminum alloy, nickel, stainless steel, etc. or tubes thereof that are subjected to surface treatment such as cutting, superfinishing, polishing, etc. after being formed by methods such as extrusion and drawing. Moreover, the endless nickel belt and endless stainless steel belt, that are disclosed in JP-A No. 52-36016, may be used as a support. Also, nickel foil of 50 μm to 150 μm thickness and polyethylene terephthalate film of 50 μm to 150 μm thickness with the surface being subjected to conductive treatment such as aluminum evaporation may be used.

A conductive powder, which is dispersed in an appropriate binder resin and applied on the above support may be used as the support of the present invention.

Examples of the conductive powder include carbon black, acetylene black, metallic powder such as aluminum, nickel, iron, nichrome, copper, zinc, silver, and the like or metal oxide powder such as conductive tin oxide, ITO, etc. Moreover, examples of binder resin, which is used simultaneously, include polystyrene resin, styrene-acrylonitrile copolymer, styrene-butadiene copolymer, styrene-maleic anhydride copolymer, polyester resin, polyvinyl chloride resin, vinyl chloride-vinyl acetate copolymer, polyvinyl acetate resin, polyvinylidene chloride resin, polyalylate resin, phenoxy resin, polycarbonate resin, cellulose acetate resin, ethylcellulose resin, polyvinyl butyral resin, polyvinyl formal resin, polyvinyltoluene resin, poly-N-vinyl carbazole, acrylic resin, silicon resin, epoxy resin, melamine resin, urethane resin, phenol resin, alkyd resin, and the like.

The conductive layer may be formed by dispersing these conductive powder and binder resin in an appropriate solvent such as tetrahydrofran, dichloromethane, methyl ethyl ketone, toluene, and the like and applying.

Further, a conductive layer formed by heat shrinkable tubes in which the conductive powder is contained in the materials such as polyvinyl chloride, polypropylene, polyester, polystyrene, polyvinylidene chloride, polyethylene, chlorinated rubber, Teflon®, etc. on an appropriate cylindrical base substance may be used as conductive support.

—Multilayer Photosensitive Layer—

The multilayer photosensitive layer at least contains a charge generating layer and a charge transport layer in this order and further contains protective layers, intermediate layers and other layers as necessary.

The charge generating layer contains at least a charge generating substance, and binder resin and further contains other elements as necessary.

The charge generating substance is not particularly limited and may be selected accordingly and any one of inorganic materials and organic materials may be used.

The inorganic material is not particularly limited and may be selected accordingly. Examples of inorganic materials include crystalline selenium, amorphous selenium, selenium-tellurium, selenium-tellurium-halogen and selenium-arsenic compound.

The organic materials are not particularly limited and may be selected accordingly from known materials. Examples of organic materials include C.I. Pigment Blue 25 (Color Index C.I. 21180), C.I. Pigment Red 41 (C.I. 21200), C.I. Sidred 52 (C.I. 45100), C.I. Basic Red 3 (C.I. 45210), azo pigments such as azo pigments having a carbazole skeleton, azo pigments having a distyryl benzene pigments, azo pigments having a triphenylamine skeleton, azo pigments having a dibenzothiophene skeleton, azo pigments having a oxiadiazole skeleton, azo pigments having a fluorenone skeleton, azo pigments having bisstilbene skeleton, azo pigments having distyryl oxiadiazole skeleton, azo pigments having distyrylcarbazole skeleton; phthalocyanine pigments such as C.I. Pigment Blue 16 (C.I. 74100); indigo pigments such as C.I. Bat Brown (C.I. 73410) and C.I. Bat Dye (C.I. 730.50); perylene pigments such as Algol Scarlet 5 (sold by Bayer Co.) and Indanthrene Scarlet R (sold by Bayer Co.); and squaric pigments. These may be used alone or in combination.

The binder resin is not particularly limited and may be selected accordingly and examples thereof include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinyl carbazole resins and polyacrylamide resins. These binder resins may be used alone or in combination.

It is also possible to further add charge transport substances as necessary. Meanwhile, polymer charge transport substances may be added as a binder resin of charge generating layers other than the above binder resins.

The method for forming the charge generating layers can be classified broadly into two categories: vacuum thin-film forming method and casting method with solution dispersion.

Examples of vacuum thin-film forming methods include glow discharge polymerization, vacuum deposition, CVD, sputtering, reactive sputtering, ion plating and accelerated ion injection which may form above-mentioned inorganic materials or organic materials satisfactorily.

The charge generating layer may be formed by a casting method using a coating liquid for charge generating layer by conventional methods such as dip coating, spray coating, bead coating, and the like.

The organic solvents used for the coating liquid for charge generating layers are not particularly limited and may be selected accordingly and examples thereof include acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofran, dioxolan, dioxane, methanol, ethanol, isopropyl alcohol, butanol, ethyl acetate, butyl acetate, dimethylsulfoxide, methyl cellosolve, ethyl cellosolve, propyl cellosolve, and the like. These may be used alone or in combination.

Of these, tetrahydrofran, methyl ethyl ketone, dichloromethane, methanol and ethanol having boiling points of 40° C. to 80° C. are particularly preferable for their easiness of being dried after coating.

The coating liquid for charge generating layers is produced by dispersing and dissolving the charge generating substance and binder resin in the above organic solvents. The method for dispersing organic pigments in organic solvents include dispersing method using dispersion media such as ball mill, bead mill, sand mill and vibrating mill and high-speed liquid impact dispersing method.

Normally, the thickness of the charge generating layer is preferably 0.01 μm to 5 μm and more preferably 0.05 μm to 2 μm.

The charge transport layer is a layer intended to retain an electrification charge, and move the charge generated and separated from the charge generating layer by exposure to unite with the retained electrification charge. In order to accomplish the purpose of retaining the electrification charge, it is required to have high electrical resistance. Moreover, in order to accomplish the purpose of obtaining high electric potential with the retained electrification charge, it is required to have less permittivity and appropriate charge mobility.

The charge transport layer at least contains charge transporting material, and binder resin and further contains other elements as necessary.

The charge transport substance include hole transporting substance, electron transport substance, polymer charge transport substance, and the like.

Examples of electron transport substances (electron-accepting substances) include chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino [1,2-b]thiophene-4-on and 1,3,7-trinitrodibenzothiophene-5,5-dioxide. These electron transport substances may be used alone or in combination.

Examples of hole transporting substance (electron-donating substance) include oxazole derivatives, oxadiazole derivatives, imidazole derivatives, triphenylamine derivatives, 9-(p-diethylaminostyrylanthracene), 1,1-bis-(4-dibenzylaminophenyl) propane, styrylanthracene, styrylpyrazoline, phenylhydrazone, α-phenyl stilbene derivatives, thiazole derivatives, triazole derivatives, phenazine derivatives, acridine derivatives, benzofuran derivatives, benzoimidazole derivatives, thiophene derivatives, and the like. These hole transporting substances may be used alone or in combination.

The polymer charge transport substances include substances having the following structures.

(a) Polymers Having a Carbazole Ring

Examples include poly-N-vinyl carbazole and compounds disclosed in JP-A Nos. 50-82056, 54-9632, 54-11737, 4-175337, 4-183719 and 6-234841.

(b) Polymers Having a Hydrazone Ring

Examples include compounds disclosed in JP-A Nos. 57-78402, 61-20953, 61-296358, 1-134456, 1-179164, 3-180851, 3-180852, 3-50555, 5-310904 and 6-234840.

(c) Polysilylene Polymers

Examples include compounds disclosed in JP-A Nos. 63-285552, 1-88461, 4-264130, 4-264131, 4-264132, 4-264133 and 4-289867.

(d) Polymers Having a Triarylamine Structure

Examples include N,N-bis(4-methylphenyl)-4-aminopolystyrene and compounds disclosed in JP-A Nos. 1-134457, 2-282264, 2-304456, 4-133065, 4-133066, 5-40350 and 5-202135.

(e) other polymers

Examples include formaldehyde polycondensation of nitropyrene and compounds disclosed in JP-A Nos. 51-73888, 56-150749, 6-234836 and 6-234837.

Examples of polymer charge transport substances other than the above include polycarbonate resins having a triarylamine structure, polyurethane resins having a triarylamine structure, polyester resins having a triarylamine structure, polyether resins having a triarylamine structure, and the like. Examples of polymer charge transport substances include compounds disclosed in JP-A Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

Moreover, polymers having an electron-donating group such as copolymers of known monomers, block polymers, graft polymers and star polymers and further, cross-linked polymers having an electron-donating group as disclosed in JP-A No. 3-109406 can be employed other than the above polymers.

Examples of binder resins include polycarbonate resins, polyester resins, methacrylic resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins and phenoxy resins. These binder resins may be used alone or in combination.

Meanwhile, the charge transport layer may contain copolymers of crosslinking binder resin and crosslinking charge transport substance.

The charge transport layer can be formed by dissolving and/or dispersing these charge transport substances and binder resins into appropriate solvents, applying them and drying. The moderate amount of additives such as plasticizer, antioxidant, leveling agent, etc. other than the charge transport substances and the binder resins may be added to the charge transport layers accordingly.

The thickness of the charge transport layer is not particularly limited and may be selected accordingly and it is preferably 5 μm to 100 μm. And thinning of the charge transport layer is reinforced due to the requirement of better image quality in these days and in order to achieve better image quality of 1,200 dpi or more, the thickness is more preferably 5 μm to 30 μm.

—Single-Layer Photosensitive Layer—

The single-layer photosensitive layer contain a charge generating substance, charge transport substance and binder resin and further contains other elements as necessary.

The above-mentioned materials may be used for the charge generating substances, charge transport substances and binder resins.

The other elements include plasticizers, fine particles and various additives.

The thickness of the single-layer photosensitive layer is preferably 5 μm to 100 μm and more preferably 5 μm to 50 μm. If the thickness is less than 5 μm, electrification property may be degraded and if the thickness is more than 100 μm, sensitivity may be lowered.

The protective layers may be formed on the photosensitive layer. The protective layer contains at least binder resin and charge transport substance and further contains other elements as necessary.

The above-mentioned materials may be used for the binder resins and charge transport substances.

Further, various additives may be added to the protective layer accordingly in order to improve adhesive property, smoothness and chemical stability.

The thickness of the protective layer is not particularly limited and may be selected accordingly and it is preferably 1 μm to 15 μm and more preferably 1 μm to 10 μm.

It is possible to form an undercoat layer between the support and the photosensitive layer accordingly. The undercoat layer is formed for the purposes of improving adhesive property, preventing moire, etc., improving coating property of upper layers and reducing residual potential.

The undercoat layer at least contains resin and fine powder and further contains other elements as necessary.

Examples of resins include water-soluble resins such as polyvinyl alcohol resins, casein and sodium polyacrylate; alcohol-soluble resins such as copolymer nylon and methoxymethylated nylon; and curable resins which form three-dimensional networks such as polyurethane resins, melamine resins, alkyd-melamine resins and epoxy resins.

Examples of fine powder include metal oxides such as titanium oxide, silica, alumina, zirconium oxide, tin oxide and indium oxide, metal sulfides or metal nitrides.

The thickness of the undercoat layer is not particularly limited and may be selected accordingly and it is preferably 0.1 μm to 10 μm and more preferably 1 μm to 5 μm.

An intermediate layer may be disposed on the support in the photoconductor as necessary in order to improve adhesive property and charge blocking property. The intermediate layer contains resins as a main constituent, and these resins are preferably having high resistance to organic solvents because solvents are used to apply photosensitive layers on these resins.

The resins may be appropriately selected for use from the resins used for the undercoat layers.

The latent electrostatic image formation is carried out, for example, by exposing the latent electrostatic image bearing member to imagewise right after uniformly charging the entire surface of the latent electrostatic image bearing member. This is performed by means of the latent electrostatic image forming unit.

The latent electrostatic image forming unit contains at least a charging unit which is configured to uniformly charge the surface of the photoconductor, and an exposing unit which is configured to expose the surface of the latent electrostatic image bearing member to imagewise light.

The charging is carried out, for example, by applying voltage to the surface of the photoconductor by means of the charging unit.

The charging unit is not particularly limited, and may be appropriately selected in accordance with a purpose. Examples of the charging unit are the conventional contact-charging unit equipped with a conductive or semiconductive roller, blush, film, or rubber blade, the conventional non-contact-charging unit utilizing corona discharge such as corotron, or scorotoron, and the like.

The charging member may be in any embodiment other than rollers, such as magnetic brush, fir brush, etc. and may be selected corresponding to specifications and embodiments of electrophotographic apparatuses. The magnetic brush uses various ferrite particles such as Zn—Cu ferrite as charging members and is made of nonmagnetic conductive sleeve which supports the charging member and magnet roll included in the nonmagnetic conductive sleeve. Firs made conductive by means of carbon, copper sulfide, metal or metal oxide, for example, may be used as material of fir brush and the firs are twisted or attached around metals or other cored bars which are made conductive to use as a charging device.

The charging device is not limited to above-mentioned contact types; however, it is preferably a contact type because it makes possible to obtain an image forming apparatus of which ozone generated from the charging device is reduced.

It is preferred that the charging device is aligned so as to be in contact or not in contact with the latent electrostatic image bearing member to charge the surface of the latent electrostatic image bearing member by applying superposed voltage with direct current voltage and alternating current voltage.

Moreover, it is preferred that the charging device is a charge roller which is aligned so as to be in proximity to, but not in contact with the latent electrostatic image bearing member through gap tapes to charge the surface of the latent electrostatic image bearing member by applying superposed voltage with direct current voltage and alternating current voltage.

The exposure is carried out, for example, by exposing the surface of the photoconductor to imagewise light by means of the exposing device.

The exposing device is not particularly limited, provided that a predetermined exposure is performed imagewise on the surface of the charged latent electrostatic image bearing member by the charging device, and may be appropriately selected in accordance with a purpose. Examples of exposure device are various exposure units such as an optical copy unit, a rod-lens-array unit, an optical laser unit, an optical liquid crystal shatter unit, and the like In the present invention, a backlight system may be applied for the exposure, in which exposure is carried out imagewise from the back side of the photoconductor.

—Developing Step and Developing Unit—

The developing step is a step to form a toner image (visible image) by developing the latent electrostatic image by using the toner and/or the developer.

<Toner>

The nearly spherical toner, which is spheronized in manufacturing steps or steps after manufacture, is preferably used from the viewpoint of uniformity and high transfer efficiency of the dots forming images.

The toner spheronized in the steps after manufacture is a pulverized toner which is spheronized by thermal or mechanical force. And the toner spheronized in the manufacturing steps is a toner prepared by polymerization such as dispersion polymerization, suspension polymerization, emulsion polymerization, etc. In particular, polymerization excels in configuration, easiness of controlling particle diameter and productivity of the toner and it is preferably used as preparing method of the spherical toner.

The average shape factor SF1 of the toner is preferably 100 to 130 and more preferably 100 to 120.

The shape factor SF1 of the toner is expressed by the following Mathematical Formula 1 and the area stands for the projected area of the toner and the maximum length stands for the maximum length of the projected image of the toner and the toner becomes more spherical as SF1 approaches 100.

$$SF1=100\times(\text{maximum length})^2\times\pi/(\text{area}\times4)$$ <Mathematical Formula 1>

The SF1 can be obtained from the observation of the toner by means of high-powered microscope such as electron microscope and the measurement of the toner image in particular.

The method for manufacturing and the material of the toner are not particularly limited and may be selected from known methods and materials accordingly and it is preferably nearly spherical toner. The method for manufacturing the toner include pulverization classification as disclosed in Journal of the Imaging Society of Japan, Vol. 43, No. 1 (2004), suspension polymerization, emulsion polymerization, polymer suspension, etc. which emulsify, cut or agglomerate oil phase in an aqueous medium to form toner base particles.

The pulverization is a method in which toner materials are melted, kneaded and then pulverized and classified to obtain base particles of the toner. In the case of pulverization, shape of the toner base particles may be controlled by giving mechanical impact to spheronize the toner. In this case, the mechanical impact may be provided to the base particles of the toner by means of hybridizer, mechanofusion, etc.

In the suspension polymerization, colorants, releasing agents, etc. are dispersed in oil-soluble polymerization initiators and polymerization monomers, and emulsified and dispersed in an aqueous medium containing surfactants and other solid dispersants, etc. by emulsion, which will be described later. After performing polymerization reaction to granulate, wet processing, in which inorganic fine particles are attached to the surface of the toner particles of the present invention, may be performed. In doing so, it is preferably performed on the toner particles, with which redundant surfactants, etc. are washed and removed.

It is possible to introduce functional group on the surface of the toner particles by partially using acids such as acrylic acid, methacrylic acid, α-cyanoacrylic acid, α-cyanomethacrylic acid, itaconic acid, crotonic acid, fumaric acid, maleic acid or maleic anhydride, acrylamide, methacrylamide, diacetone acrylamide or methylol compounds thereof, vinylpyridine, vinylpyrrolidone, vinylimidazole, ethylenimine and acrylate or methacrylate having amino groups such as dimethylaminoethyl methacrylate for the polymerization monomer.

Furthermore, it is possible to let dispersant survive on the particle surface by absorption and introduce functional groups by selecting dispersants having acid groups or basic groups.

In the emulsion polymerization, water-soluble polymerization initiator and polymerization monomers are emulsified in water using surfactants and a latex is synthesized by normal emulsion polymerization. A dispersing element in which colorants, releasing agents, etc. are dispersed in an aqueous medium is provided, and it is agglomerated into a size of the toner after mixing and a toner is obtained by heat fusing. Afterward, wet processing of inorganic fine particles may be performed. It is possible to introduce functional groups to the surface of toner particles by using a substance equivalent to the monomers which can be used for suspension polymerization as latex.

Among them, it is preferably the toner, which is granulated by emulsifying and/or dispersing the melted and/or dispersion liquid of toner materials in an aqueous medium because of high selectivity of resins, high fixing property at a low temperature, excellent granulation property and easiness of controlling particle diameter, particle size distribution and shapes.

The solution of the toner material contains the toner material dissolved in a solvent and dispersion liquid of the toner material contains the toner material dispersed in a solvent.

The toner material contains at least adhesive base material which can be obtained from a reaction between active hydrogen group-containing compound, polymers reactive with the active hydrogen group-containing compound, binder resin, releasing agent and colorant and further contains other elements, such as resin fine particles, charge control agent, etc. as necessary.

The adhesive base material exhibits adhesive property toward recording media such as paper, etc. and at least contains adhesive polymers obtained from reaction between active hydrogen group-containing compound and polymers reactive with the active hydrogen group-containing compound in the aqueous medium and may further contain binder resins appropriately selected from known binder resins.

The volume average particle diameter of the toner Dt is preferably 2 μm to 7 μm and more preferably 3 μm to 6 μm. If the volume average particle diameter Dt is less than 2 μm, the ratio of fine powder toner of 1 μm or less particle diameter, which is likely to cause image defects, may become large, and if the volume average particle diameter Dt is more than 7 μm, it may be difficult to accommodate the requirement of higher image quality of electrophotographic images.

The external additives of large particle diameter having an average particle diameter Da of 100 nm to 300 nm are used for the toner. If the average particle diameter Da is less than 100 nm, effect of preventing burial of external additives may be unsatisfactory, and if the average particle diameter Da is more than 300 nm, adhesive property toward the toner base particles is lowered and the external additives tend to separate from the toner and constructional elements of the image forming apparatus such as photoconductors are likely to be damaged due to separated external additives. Moreover, external additives with a small particle diameter are effective for improving flowability of the toner and parallel usage of the external additives having an average particle diameter of 100 nm or less is preferred for the toner used for the present invention.

The coverage of the external additives of large particle diameter having an average particle diameter Da of 100 nm to 300 nm is preferably 5% to 90%, more preferably 15% to 75% and most preferably 30% to 60%. If the external additive coverage is less than 5%, the effect of preventing burial of external additives is insufficient and as the coverage increases, the effect of preventing burial becomes more persistent. If the coverage is more than 90%, external additives are likely to be separated because external additives not directly covering the toner base particles increase.

The external additive coverage increases as the loadings of external additives increases, however, effects from various causes such as particle diameter and shape of the toner base particles, particle diameter and shape of the external additives, and mixing condition with toner base particles, etc. are not negligible. Furthermore, the external additive coverage varies between toners, and further, covering condition on the surface of the toner base particles is not uniform. Covering between toners and the surface of base particles with external additives of large particle diameter are unconsidered heretofore.

The method for mixing is not particularly limited and may be selected accordingly and known methods using various mixing apparatuses such as V-type blender, Henschel mixer and mechanofusion, etc may be used. It is possible to attach external additives of large particle diameter to the toner uniformly with coverage of a certain level or more by making efforts such as performing loosening treatment of the external additives right before mixing external additives or mixing in stages from gentle condition to demanding condition.

The external additives are not particularly limited and may be selected accordingly form known organic fine particles or inorganic fine particles. It is preferable to use any one or more of silica, titanium and alumina, for example as the inorganic fine particles. These inorganic fine particles having hygroscopic property are preferably being hydrophobized in consideration of environmental stability. The hydrophobization may be performed by reacting hydrophobizing agent with the fine powder at a high temperature.

The hydrophobizing agent is not particularly limited and may be selected accordingly and examples include silane coupling agent and silicone oil.

<Developer>

The developer contains at least the toner and contains other elements selected accordingly such as carriers. The developer may be single component developer or two-component developer and it is preferably the two-component developer in terms of improving duration of life when the developer is used for high-speed printers which correspond to recent improvement of information processing speed.

The single component developer using the toner, even if addition and reduction of the toner take place, exhibits less fluctuation in particle diameter of the toner, no filming of the toner to the developing roller or fusion of the toner to the members such as blade used for thinning of the toner and development property and images, which are appropriate and stable even after long-term use (stirring) in the developing device, can be obtained. Moreover, the two-component developer, even if addition and reduction of the toner take place, exhibits less fluctuation in particle diameter of the toner in the developer, and development property, which is appropriate and stable even after long-term stirring in the developing device, can be obtained.

The carrier is not particularly limited and may be selected accordingly and it is preferably the carrier having core material and resin layer applied to the core material.

The material of the core material is not particularly limited and may be selected from known core materials. For example, it is preferably manganese-strontium (Mn—Sr) material and manganese-magnesium (Mn—Mg) material of 50 emu/g to 90 emu/g and preferably high magnetization material such as iron powder (100 emu/g or more) and magnetite (75 emu/g to 120 emu/g) in terms of assuring image density. Moreover, it is preferably a low magnetization material such as copper-zinc (Cu—Zn) of 30 emu/g to 80 emu/g because the impact toward the photoconductor where the toner is being in a form of magnetic brush can be softened and it is advantageous for higher image quality. These may be used alone or in combination.

The average particle diameter, volume average particle diameter ($D_{50}$) of the core material is preferably 10 μm to 200 μm and more preferably 20 μm to 100 μm.

The material of the resin layer is not particularly limited and may be selected from known resins accordingly. Examples include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoroterpolymer such as terpolymer of tetrafluoroethylene, vinylidene fluoride and non-fluoro monomer and silicone resin. These may be used alone or in combination.

The resin layer may contain conductive powder as necessary and examples of the conductive powder include metal powder, carbon black, titanic oxide, tin oxide, zinc oxide, and the like. The average particle diameter of these conductive powders is preferably 1 μm or less. If the average particle diameter is more than 1 μm, it may be difficult to control electrical resistance.

The resin layer may be formed by uniformly coating the surface of the core material with a coating solution, which is prepared by dissolving silicone resins, etc. in a solvent, by known coating method, and baking after drying. The examples of the coating method include dipping, spraying and brushing.

The solvent is not particularly limited and may be selected accordingly and examples include toluene, xylene, methyl ethyl ketone, methyl isobutyl ketone, cellosolve and butyl acetate.

The baking is not particularly limited and may be external heating or internal heating and examples include methods using fixed electric furnace, fluid electric furnace, rotary electric furnace, burner furnace and methods using microwaves.

The carrier amount in the resin layers is preferably 0.01% by mass to 5.0% by mass.

If the amount is less than 0.01% by mass, the resin layer may not be formed uniformly on the surface of the core material and if the amount is more than 5.0% by mass, the resin layer becomes too thick and granulation between carriers occur and uniform carrier particles may not be obtained.

If the developer is the two-component developer, the carrier content in the two-component developer is not particularly limited and may be selected accordingly and it is preferably 90% by mass to 98% by mass and more preferably 93% by mass to 97% by mass, for example.

With regard to the mixing ratio of toner and carrier in the two-component developer, the toner is 1 part by mass to 10.0 parts by mass relative to 100 parts by mass of the carrier in general.

The toner image (visible image) may be formed by developing the latent electrostatic image using the toner and/or the developer and by means of the developing unit.

The developing unit is not particularly limited and may be selected from known developing unit accordingly as long as it can perform developing using the toner and/or the developer. Preferred examples include a developing unit which has at least a developing device containing the toner and/or the developer, which can provide the toner and/or the developer to the latent electrostatic image by contact or without contact.

The developing device may be of dry development type or wet development type and may be for single color or multicolor and preferred examples include developing device which has a stirrer which charges the toner and/or developer by friction stirring, and rotatable magnet roller.

In the developing device, the toner and the carrier are stir mixed to charge the toner with the friction and retain the toner in a condition of magnetic brush on the surface of rotating magnet roller. Since the magnet roller is positioned near the latent electrostatic image bearing member (photoconductor), part of the toner constructing the magnetic brush formed on the surface of the magnet roller moves to the surface of the latent electrostatic image bearing member (photoconductor) by electric attraction. As a result, the latent electrostatic image is developed by the toner to form a visible image by the toner on the surface of the latent electrostatic image bearing member (photoconductor).

—Transferring Step and Transferring Unit—

The transferring step is a step to transfer the visible image to a recording medium and it is preferably an embodiment using intermediate transfer member in which a visible image is transferred primarily on the intermediate transfer member and then the visible image is transferred secondarily to the recording medium. And it is more preferably an embodiment using the toner of two or more colors or preferably full-color toner and containing a primary transferring step in which a visible image is transferred to the intermediate transfer member to form a compound transfer image and a secondary transferring step in which the compound transfer image is transferred to a recording medium.

The transferring of the visible image may be performed by charging the latent electrostatic image bearing member (photoconductor) by means of transfer charging device and by the transferring unit. The preferred embodiment of the transferring unit contains primary transferring unit in which a visible image is transferred to the intermediate transfer member to form a compound transfer image and secondary transferring unit in which the compound transfer image is transferred to a recording medium.

Meanwhile, the intermediate transfer member is not particularly limited and may be selected from known transfer member accordingly and examples include transfer belt, etc.

The volume resistivity of the intermediate transfer member is preferably adjusted within the range of $10^7$ Ωcm to $10^{14}$ Ωcm. If the volume resistivity of the intermediate transfer member is less than $10^7$ Ωcm, charge leakage occurs and the transfer efficiency tends to be lowered. If the volume resistivity is more than $10^{14}$ Ωcm, residual charge is likely to occur after transferring and charge removing equipment may be needed.

The material of the intermediate transfer member is not particularly limited and may be selected from known materials accordingly. Examples include (1) a material of high Young's modulus (modulus of elongation) used as a single-layer belt such as PC (polycarbonate), PVDF (polyvinylidene fluoride), PAT (polyalkylene terephthalate), blended material of PC (polyearbonate) and PAT (polyalkylene terephthalate), blended material of ETFE(ethylenetetrafluoroethylene copolymer) and PC, blended material of ETFE and PAT, blended material of PC and PAT and heat-curable polyimide with carbon black dispersion. These single-layer belts of high Young's modulus have less deformation volume relative to the stress during image forming and have advantage of hardly having registration misalignment during color image forming in particular. Examples also include (2) a belt of two to three-layer composition having the belt of high Young's modulus as a base layer and a surface layer or intermediate layer is provided on its periphery. These belts of two to three-layer composition have a function to prevent hollow defects of line images which are caused by hardness of the single-layer belt. And examples also include (3) a belt using rubber or elastomer with relatively low Young's modulus which has an advantage of hardly having hollow defects of line images due to its softness. Moreover, since belt width is wider than activation roll and extended roll and meandering is prevented by using elasticity of the side of the belt which is prominent more than the rollers, it does not require alignment ribs or meandering-preventing apparatus, attributing to cost reduction.

The conductive agents for resistance adjustment used for the elastic belts are not limited and may be selected accordingly. Examples thereof include carbon black, graphite, metal powders such as aluminum, nickel, and the like and electric conductive metal oxides such as tin oxide, titanium oxide, antimony oxide, indium oxide, potassium titanate, antimony tin oxide (ATO), indium tin oxide (ITO), and the like. The conductive metal oxides may be coated with insulating particles such as barium sulfate, magnesium silicate, calcium carbonate, and the like.

Materials of the surface layer are required to be able to prevent contamination of the photoconductor by elastic material as well as to reduce the surface friction of the transfer belt so that cleaning ability and the secondary transfer property are improved. For example, the surface layer preferably contains one type or two or more types of polyurethane resin, polyester resin, epoxy resin, and the like and materials which reduces surface energy and enhances lubrication, powders or particles such as fluorine resin, fluorine compound, carbon fluoride, titanium dioxide, silicon carbide, and the like, which can be used as a dispersion of one type, two or more types or a combination of powders or particles of different diameters. In addition, it is possible to use a material such as fluorine rubber that has been treated with heat so that a fluorine-rich layer is formed on the surface and the surface energy is reduced.

Examples of the method for producing elastic belts include, but not limited to centrifugal forming in which material is poured into a rotating cylindrical mold to form a belt, spray application in which a liquid paint is sprayed to form a film, dipping method in which a cylindrical mold is dipped into a solution of material and then pulled out, injection mold method in which material is injected into inner and outer mold, and a method in which a compound is applied onto a cylindrical mold and the compound is vulcanized and grounded. The method for producing belts is not limited to above methods, and it is common to produce belts with a combination of multiple methods.

The transferring unit (the primary transferring unit and the secondary transferring unit) preferably contains at least a transferring device which is configured to charge so as to separate the visible image from the latent electrostatic image bearing member (photoconductor) and transfer onto a recording medium. In the image forming apparatus of the present invention, either one, or plurality of transferring units are disposed.

Examples of the transferring device are a corona transferring device utilizing corona discharge, a transfer belt, a transfer roller, a pressure-transfer roller, an adhesion transferring device, and the like.

The typical recording medium is regular paper, however, it is not particularly limited and may be selected accordingly as long as it is capable of transferring unfixed images after developing and PET base for OHP is also usable.

The fixing is a step to fix the visible image transferred onto a recording medium using a fixing device. The fixing step can be performed for each toner of different colors as it is being transferred to the recording medium, or in one operation where each toner of different colors are layered.

The fixing device is not particularly limited and may be appropriately selected in accordance with a purpose. However, conventional heating and pressurizing units are preferable. The heating and pressurizing units include a combination of a heating roller and a pressurizing roller and a combination of a heating roller, a pressurizing roller, and an endless belt, and the like.

In general, the heating and pressurizing units preferably provide heating to 80° C. to 200° C.

In the present invention, for example, a conventional photo-fixing device can be used along with or in place of the fixing step and fixing unit.

The charge removing is a step of applying a bias to the charged photoconductor so as to remove the charge. This is suitably performed by the charge removing unit.

The charge removing unit is not particularly limited, provided that a bias is applied to the charged photoconductor to thereby remove the charge, and can be appropriately selected from the conventional charge removing units in accordance with a purpose. A suitable example thereof is a charge removing lamp.

The cleaning is a step of removing the residual electrophotographic toner on the photoconductor. This is suitably performed by means of a cleaning unit.

The cleaning unit is not particularly limited, provided that the residual electrophotographic toner on the photoconductor is removed, and can be appropriately selected from the conventional cleaners in accordance with a purpose. Examples thereof are a magnetic blush cleaner, a electrostatic brush cleaner, a magnetic roller cleaner, a blade cleaner, a blush cleaner, a wave cleaner, and the like.

The recycling is a step of recycling the electrophotographic toner collected by the cleaning to the developing unit. This is suitably performed by means of a recycling unit.

The recycling unit is not particularly limited, and may be appropriately selected from the conventional conveyance systems.

The controlling is a step of controlling each of the aforementioned steps. This is suitably performed by means of a control unit.

The control unit is not particularly limited, provided that each of the aforementioned units or members is controlled, and can be appropriately selected in accordance with a purpose. Examples thereof are devices such a sequencer, a computer, and the like.

Figure 3:
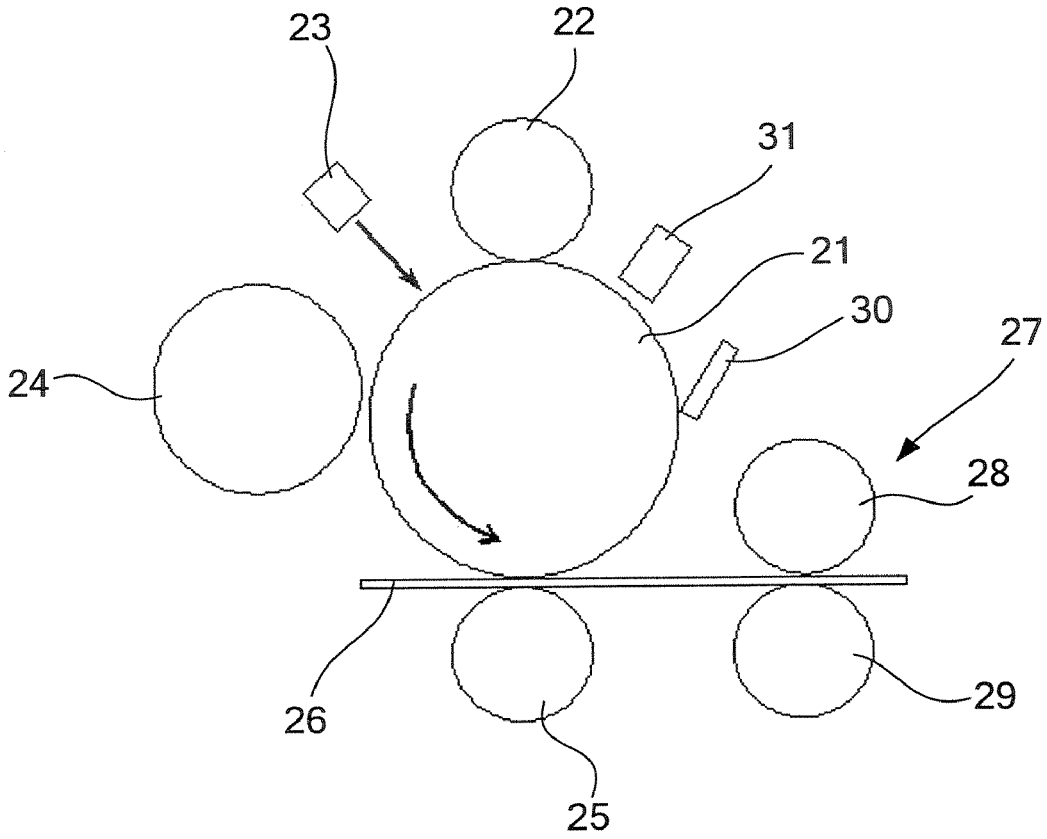
FIG. 3 is a schematic block diagram showing an exemplary image forming apparatus of the present invention.

FIG. 3 is a schematic block diagram showing an exemplary image forming apparatus of the present invention. In FIG. 3, a charging device 22 for charging the surface of a photoconductor drum 21, an exposure device 23 which forms a latent image on the charged surface, a developing device 24 which forms a toner image by attaching the charged toner to the latent image on the drum surface, a transferring device 25 which transfers the toner image formed on the drum surface onto a recording medium 26, a fixing device 27 which fixes the toner on the recording medium, a cleaning device 30 for removing and collecting the residual toner on the drum surface and a charge removing device 31 for removing the residual electric potential on the drum surface, are arranged in the order around the photoconductor drum 21, which is a latent electrostatic image bearing member.

The surface of the photoconductor drum 21 is uniformly charged by the charging roller 22. In FIG. 3, the photoconductor drum 21 is charged with the charging roller, however, corona charging such as corotron or scorotron may also be used. Note that the electrification resulted by using charging rollers has advantage over corona charging in having less ozone generation.

A laser beam 23 is irradiated to the charged photoconductor drum 21 corresponding to image information to form a latent electrostatic image. It is possible to detect the electrification potential or exposed region on the photoconductor drum 21 by means of a potential sensor and to control charging condition or exposure condition.

And a toner image is formed on the photoconductor drum 21 on which the latent electrostatic image is formed by means of the developing device 24.

Figure 4:
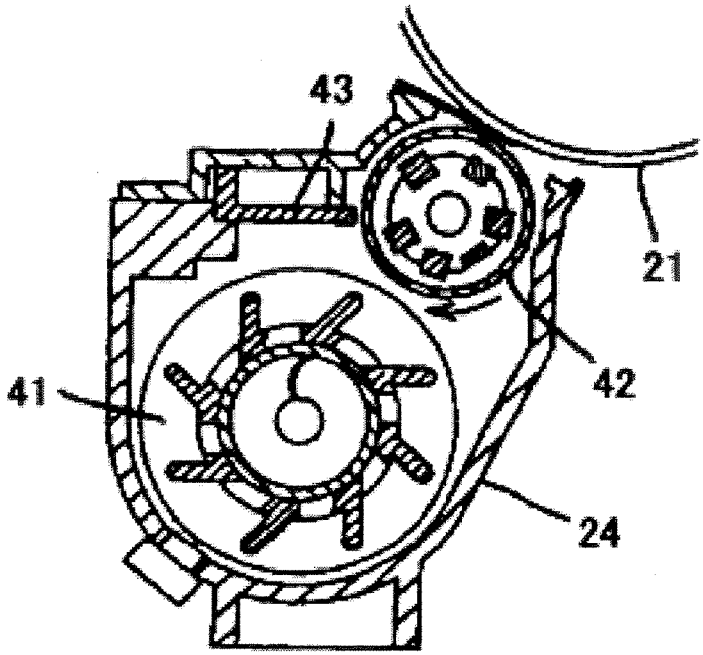
FIG. 4 is a schematic block diagram showing an exemplary developing device of the present invention.

An exemplary structure of the developing device 24, when the developing device 24 is a two-component developing device which uses two-component developer containing toner and carrier is shown in FIG. 4. In this example, developer is stirred and transported by a screw 41 and sent to a developing sleeve 42. The developer sent to the developing sleeve 42 is regulated by a doctor blade 43 and the supplied amount of the developer is controlled by a doctor gap, which is a space between the doctor blade 43 and the developing sleeve 42. If the doctor gap is too small, the amount of developer is not sufficient, leading to image density insufficiency. And if the doctor gap is too large, the developer is excessively supplied in amount, causing a problem of carrier attachment on the photoconductor drum 21. The developing sleeve 42 is equipped with magnet which forms a magnetic field so as to hold the developer vertically on the peripheral surface. The developer is held vertically in form of chains on the developing sleeve 42 along the magnetic field lines which are radiated from the magnet in the normal line direction.

The developing sleeve 42 and the photoconductor drum 21 are arranged so as to be adjacent to each other with a certain space (development gap) in between and a developing region is formed where the developing sleeve 42 and the photoconductor drum 21 are facing each other. The developing sleeve 42 is made of non-magnetic substance such as aluminum, brass, stainless steel and conductive resin in form of cylinder, and it is rotated by a rotary drive mechanism (not shown). The magnetic brush is transported to the developing region by the rotation of the developing sleeve 42. A developing voltage is applied to the developing sleeve 42 by means of a power source for development (not shown), the toner on the magnetic brush is separated from the carrier by means of development field formed between the developing sleeve 42 and the photoconductor drum 21, and is developed on the latent electrostatic image on the photoconductor drum 21. It is also possible for the developing voltage to be overlapped with alternating current. Meanwhile, the development gap can be set to approximately 5 times to 30 times as much of the particle diameter of the developer, and if the particle diameter of the developer is 50 μm, the development gap can be set to 0.5 mm to 1.5 mm. If the development gap is wider than the above, it is difficult to obtain desired image density.

Furthermore, doctor gap need to be approximately equal to or somewhat larger than the development gap. The drum diameter or drum linear density of the photoconductor drum 21 and the sleeve diameter or sleeve linear density of the developing sleeve 42 are determined depending on the copying speed or size of the apparatus, etc. The ratio of the sleeve linear velocity to the drum linear velocity is preferably 1.1 or more for obtaining required image density. It is also possible to install a sensor in a position after developing and control the process condition by detecting the amount of toner attachment from optical reflectance.

A two-component developing device is used as a developing device in FIG. 4, however, the present invention is not limited to the two-component developing device and it is possible to use single component developing device in which a thin toner layer formed on a developing sleeve is developed on a photoconductor by electrical field.

A toner image formed on the photoconductor drum 21 is transported to the transfer nip to which the photoconductor drum 21 and the recording medium 26 are in contact with. A transfer voltage, which is opposite of the toner, is applied to the roller 25, which is in contact with the recording medium 26 transported from a paper feed tray (not shown) and the toner image formed on the photoconductor drum 21 is transferred on the recording medium 26 by the transfer electrical field which works in between the recording medium 26 and the photoconductor drum 21.

The recording medium 26, on which unfixed toner image is formed, receives a certain heat and pressure from a fixing roller 28 and a pressurizing roller 29 and the toner image is fixed on the recording medium 26. A thermistor (not shown) is in contact with the fixing roller 28 in order to maintain a constant fixing temperature of the fixing roller 28. The fixing method using a fixing roller is high in thermal efficiency, excels in safety, may possibly be downsized and has a wide applicable scope from low-speed to high-speed.

The residual toner on the photoconductor drum 21 is removed by the cleaning device 30 and also, a cleaning blade may be used as a cleaning device and cleaning rollers or cleaning brushes may be used simultaneously. Moreover, an opposite voltage of the toner may be applied to these cleaning members to increase cleaning efficiency.

Figure 5:
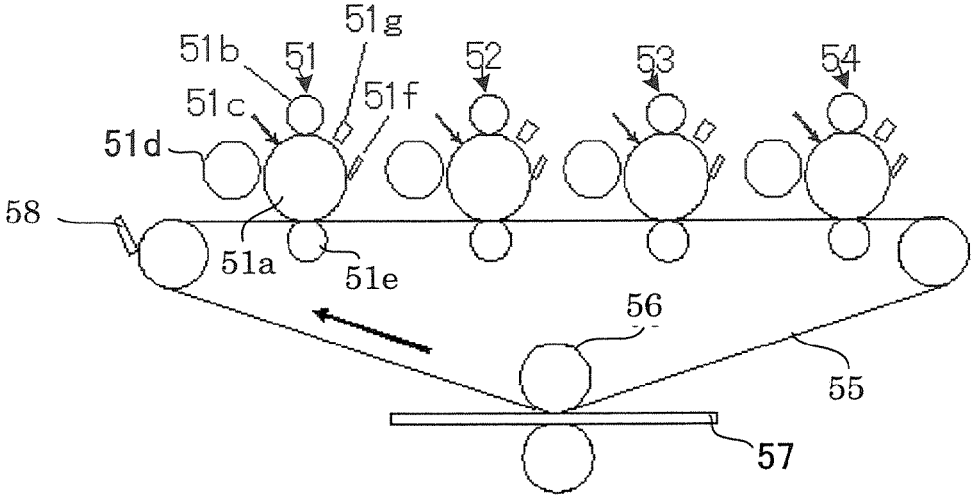
FIG. 5 is a schematic block diagram showing another exemplary image forming apparatus of the present invention.

FIG. 5 is a schematic block diagram showing another exemplary color image forming apparatus of the present invention. The color image forming apparatus 51 is equipped with a charging device 51*b*, exposure device 51*c*, developing device 51*d*, transferring device 51*e*, cleaning device 51*f* and charge removing device 51*g* which are arranged around a photoconductor drum 51*a*. An image of yellow toner formed on the photoconductor drum 51*a* is transferred onto an intermediate transfer belt 55 by means of the transferring device 51*e* and residual toner on the photoconductor drum 51*a* is removed by means of the cleaning device 51*f*. Similarly, each image of magenta toner, cyan toner and black toner is formed on the intermediate transfer belt 55 by means of devices 52 to 54. The color image on the intermediate transfer belt 55 is transferred onto the recording medium 57 by means of the transferring device 56 and residual toner on the intermediate transfer belt 55 is removed by means of the cleaning device 58. The color image formed on the recording medium 57 is fixed by means of a fixing device (not shown). The forming order of color images is not specified and the images may be formed in any orders.

The above image forming apparatus of the present invention is characterized by having high transfer efficiency of toner and being capable of producing images stably even after long-term use without having image defects such as "hollow defects".

When the image forming apparatus as shown in FIG. 3 and FIG. 5 is used for prolonged periods, additives applied on the surfaces of the toner in the developing device, which has been mechanically stressed without being consumed, may be buried inside the toner or separated from the toner and adhesion between toner and other members and between toners increases because the contact between toner base particles and other members and between toner base particles themselves increases resulting in an increase of contact area. When toner adhesion increases, transfer ratio decreases because it is impossible to separate toner from the photoconductor by Coulomb's force of transfer electrical field. Moreover, when a toner layer formed of the toner with large adhesion is compressed by pressure during transferring, toner adhesion, especially non-electrostatic adhesion such as van der Waals force or capillary force which do not depend on electrification of the toner, increases and agglomeration of toner occurs which is likely to cause hollow defects.

Therefore in the present invention, external additives of large particle diameter, which is unlikely to be buried within the toner, is used to inhibit toner adhesion increase due to mechanical stress, and non-electrostatic adhesion is adjusted to be in an appropriate range to inhibit the occurrence of "hollow defects" in order to have high transfer efficiency even after long-term use and to prevent image defects such as "hollow defects". A range of non-electrostatic adhesion between toner and photoconductor is provided in JP-A No. 2000-66441, however, because non-electrostatic adhesion is proportional to the particle diameter of toner and magnitude of Coulomb's force of transfer electrical field also depends on the particle diameter of toner, the range of non-electrostatic adhesion where "hollow defects" hardly occurs differs depending on the particle diameter of toner and if the particle diameter of toner is small in particular, the provided range is not appropriate. Moreover, a range of proportionality coefficient of particle diameter-dependent non-electrostatic adhesion is provided in JP-A Nos. 2001-318485 and 2001-255677 and it is applicable for toner of small particle diameter. However, even though non-electrostatic adhesion depends on the particle diameter of external additives, the relation of non-electrostatic adhesion and particle diameter of external additives is not defined and the relation between non-electrostatic adhesion and "hollow defects" when external additives of large particle diameter are used in particular are not thoroughly examined in the above Patent Literatures.

As regard to the toner, in which toner base particles of various particle diameters are coated with external additives of various particle diameters and materials, an average F of non-electrostatic adhesion between toner and photoconductor was measured by centrifugal method. As a result, non-electrostatic adhesion F is proportional to the volume average particle diameter Dt of the toner, and the proportionality coefficient $\alpha$ increases as the average particle diameter Da of external additives increases. Moreover, proportionality coefficient $\alpha$ depends on the material and coverage of the external additives and proportionality coefficient $\alpha$ decreases as coverage of external additives increases and it is likely to saturate with more than a certain coverage of external additives. Further, coverage of external additives is defined as a percentage of an area where external additives are attached relative to an outer area of one toner particle and may be measured by an image analysis of electron micrograph of the toner.

An evaluation of "hollow defects" produced by the image forming apparatus as shown in FIG. 3 was conducted for the toner with non-electrostatic adhesion being measured and as a result, it turns out that tendency of "hollow defects" occurrence depends not only on the proportionality coefficient $\alpha$ but also on the average particle diameter Da of external additives and as $\alpha$/Da increases, it is likely for "hollow defects" to occur.

The reason why the occurrence of "hollow defects" depends on the average particle diameter Da of external additives is thought that because non-electrostatic adhesion between toner and other members and between toners increases by a compression of the toner layer and the degree of increase differs depending on Da.

Therefore, it is required in the present invention to use external additives of large particle diameter which has an average particle diameter Da of 100 nm to 300 nm and the value obtained from dividing F which corresponds to proportionality coefficient $\alpha$ by product of Dt and Da, [F/(Dt×Da)] needs to be $7.5\times10^4$ (N/m$^2$) or less and preferably $7\times10^4$ (N/m$^2$) or less. By fulfilling the above condition, it is possible to obtain appropriate image quality without having image defects such as "hollow defects" even when the image forming apparatus is used for prolonged periods.

If the obtained value from [F/(Dt×Da)] is more than $7.5\times10^4$ (N/m$^2$), image defects such as "hollow defects" or transfer ratio degradation may occur when the image forming apparatus is used for prolonged periods.

The toners are repelling each other by electrostatic forces in the toner layer; however, toners are tied down in the toner layer by non-electrostatic adhesion between toners. Therefore, if non-electrostatic adhesion between toners is weak, toner is likely to separate from the toner layer and "toner scattering" tends to occur due to attachment of separated toner around the images. As a result of conducting evaluation of "toner scattering" for the toner with non-electrostatic adhesion being measured, it turns out that the obtained value from [F/(Dt×Da)] was $2.0\times10^4$ (N/m$^2$) or more and "toner scattering" was unlikely to occur.

Moreover, since it is impossible to obtain appropriate image quality if transfer property varies with color during color image forming, each toner of different colors needs to fulfill the condition of the above [F/(Dt×Da)].

Next, the measurement of non-electrostatic adhesion between toners and photoconductors by centrifugal method will be explained.

A method, in which a force needed to separate the toner from a substance to which the toner is attached is estimated, is common as a measurement method of non-electrostatic adhesion of the toner. Examples of known methods for separating toners include centrifugal force, oscillation, impact, air pressure, electrical field, magnetic field, etc. Of these, the method using centrifugal force is particularly preferable as a measurement method of adhesion between toners and photoconductors from the view point of easy quantification and high measurement accuracy.

The method for measuring toner adhesion by centrifugal separation will be explained below. A centrifugal separation method such as the one described in IS&T NIP7th p. 200 (1991) is known.

Figure 2:
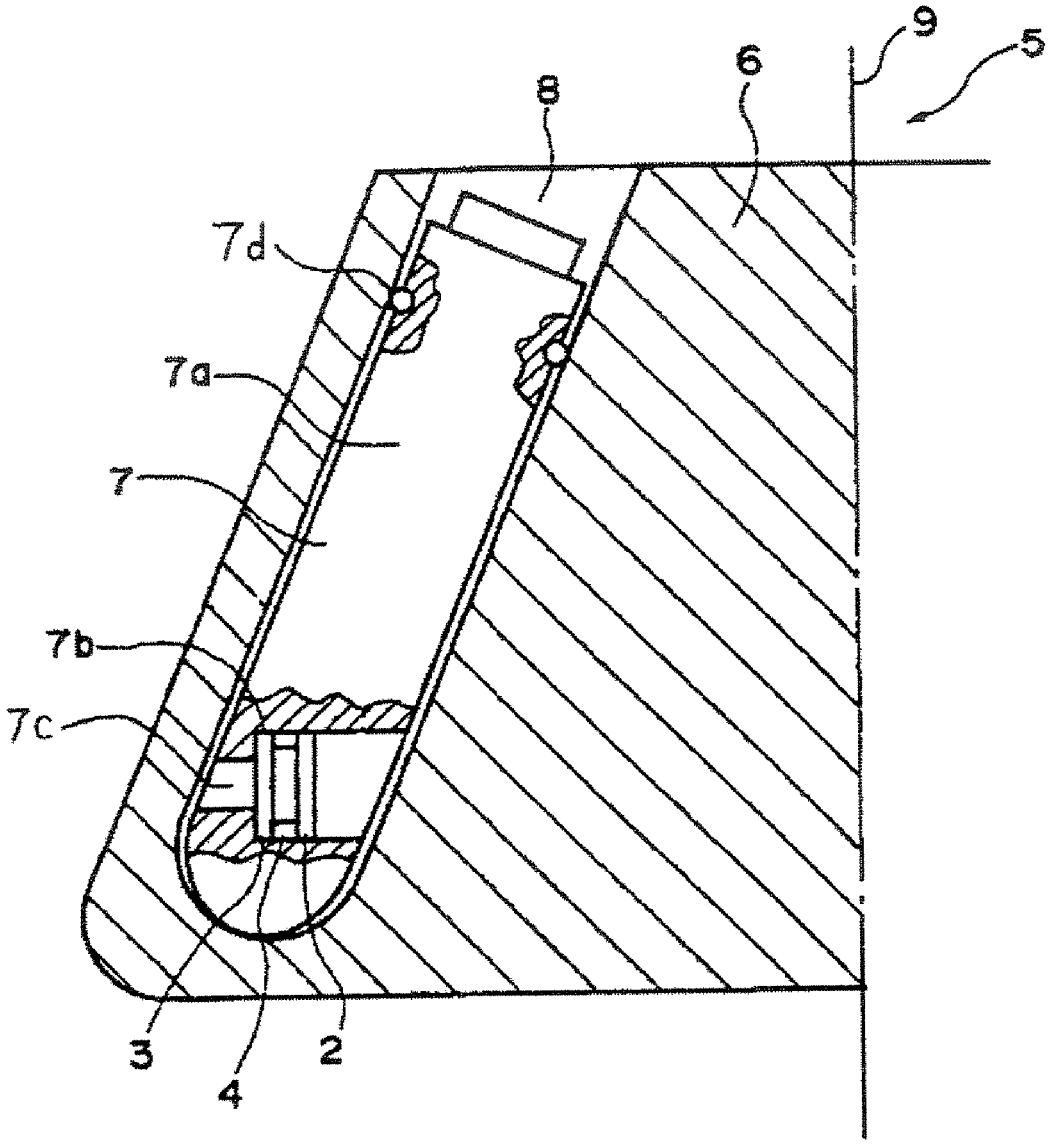
FIG. 2 is a partial cross-sectional side view of a centrifugation apparatus in the powder adhesion measurement apparatus of the present invention.

FIGS. 1 and 2 are diagrams showing examples of measurement cell in a toner adhesion measurement apparatus and centrifugation apparatus.

FIG. 1 is an explanatory diagram of the measurement cell in the toner adhesion measurement apparatus. In FIG. 1, "1" represents a measurement cell and the measurement cell 1 is composed of a sample substrate 2 which has a sample surface 2*a* to which toner is attached, a receiving substrate 3 which has an attachment surface 3*a* to which the toner separated from the sample substrate 2 is attached and a spacer 4 disposed between the sample surface 2*a* of the sample substrate 2 and the attachment surface 3*a* of the receiving substrate 3. FIG. 2 is a partial cross-sectional side view of the centrifugation apparatus.

In FIG. 2, "5" indicates a centrifugal apparatus and the centrifugal apparatus 5 is equipped with a rotor 6 which rotates the measurement cell 1 and a holding member 7. The rotor 6 has an opening in the cross-section surface perpendicular to its rotation center axis 9 and contains a sample setting part 8 into which the holding member 7 is placed. The holding member 7 is equipped with a rod-like part 7*a*, a cell-holding part 7*b* disposed in the rod-like part 7*a* which holds the measurement cell 1, an opening part 7*c* for pushing the measurement cell 1 out of the cell holding part 7*b* and a fixing part 7*d* by which the rod-like part 7*a* is fixed in the sample setting part 8. The cell holding part 7*b* is organized so that the vertical direction of the measurement cell 1 is perpendicular to the rotation center axis 9 of the rotor when the measurement cell 1 is placed.

The method for measuring non-electrostatic adhesion which exists between toners and photoconductors will be explained referring to the above apparatus.

First, a photoconductor is formed on the sample substrate 2 or, a part of the photoconductor is cut out and bonded on the sample substrate 2 with adhesion bond. And then uncharged toner is attached to the photoconductor (sample surface 2*a*) on the sample substrate 2.

Next, as shown in FIG. 1, a measurement cell 1 is constructed with the sample substrate 2, receiving substrate 3 and spacer 4. The measurement cell 1 is set in the cell holding part 7*b* of the holding member 7 in a way so that when the holding member 7 is set in the sample setting part 8 of the rotor 6, the sample substrate 2 is in between the receiving substrate 3 and the rotation center axis 9 of the rotor 6. The holding member 7 is set in the sample setting part 8 of the rotor 6 so that the vertical direction of the measurement cell 1 is perpendicular to the rotation center axis 9 of the rotor. The centrifugal separator 5 is activated to rotate the rotor 6 at a constant rotational frequency. The toner attached to the sample substrate 2 receives the centrifugal force corresponding to the rotational frequency and when the centrifugal force received by the toner is larger than the adhesion between the toner and the sample surface 2*a*, the toner is separated from the sample surface 2*a* and attached to the bonding surface 3*a*.

The centrifugal force Fc received by the toner is obtained from the following Mathematical Formula 2 employing mass "m" of the toner, rotational frequency "f" (rpm) of the rotor and distance "r" from the center axis of the rotor to the toner bonding surface of the sample substrate.

$$Fc=m\times r\times(2\pi f/60)^2 \qquad \text{<Mathematical Formula 2>}$$

Mass "m" of the toner is obtained from the following Mathematical Formula 3 employing absolute specific gravity "ρ" and diameter "d" of the toner.

$$m=(\pi/6)\times\rho\times d^3 \qquad \text{<Mathematical Formula 3>}$$

Moreover, centrifugal force Fc received by the toner is obtained from the following Mathematical Formula 4 based on the above Mathematical Formulas 2 and 3.

$$Fc=(\pi^3/5400)\times\rho\times d^3\times r\times f^2 \qquad \text{<Mathematical Formula 4>}$$

After centrifugal separation is finished, the holding member 7 is taken out from the sample setting part 8 of the rotor 6 and the measurement cell 1 is taken out from the cell holding part 7*b* of the holding member 7. The receiving substrate 3 is changed, the measurement cell 1 is set in the holding member 7, the holding member 7 is set in the rotor 6 and the rotor 6 is rotated at a higher rotational frequency than the last time. The centrifugal force received by the toner becomes larger than the last time, and the toner with strong adhesion is separated from the sample surface 2*a* and attached to the bonding surface 3*a*. By carrying out the same operation while changing the rotational frequency of the centrifugal separator from low frequency to high frequency, the toner on the sample surface 2*a* is moved to the bonding surface 3*a* corresponding to the magnitude relation between centrifugal force received at each frequency and adhesion.

After performing centrifugal separation for all rotational frequencies, particle diameter of the toner attached to the bonding surface 3*a* of the receiving substrate 3 at each rotational frequency is measured. The measurement of particle diameter of each toner is conducted using an image processing apparatus by observing the toner on the bonding surface 3*a* by means of an optical microscope and entering the image of the attached surface into the image processing apparatus through CCD camera. The adhesion of the toner separated at some rotational frequency was weaker than the centrifugal force generated at the same frequency and it was stronger than the centrifugal force generated at the frequency before separation. Each centrifugal force at both frequencies was calculated from the above Mathematical Formula 1 and the average was defined as an adhesion of the toner. The average F of toner adhesion can be obtained by calculating arithmetic mean value A of the common logarithm of each toner adhesion and from $F=10^A$.

By using the image forming apparatus and the image forming method of the present invention, appropriate images with high transfer ratio can be obtained stably even after long-term use without having image defects such as "hollow defects" by fulfilling the condition of the above [F/(Dt×Da)].

EXAMPLES

Herein below, with referring to Examples and Comparative Examples, the invention is explained in detail and the following Examples and Comparative Examples should not be construed as limiting the scope of this invention.

Example 1

Preparation of Toner A

—Preparation of Graft Carbon Black—

40 parts by mass of styrene monomer, 20 parts by mass of carbon black (MA100 by Mitsubishi Chemical Corp.) and 0.5 parts by mass of 2,2'-azobisisobutyronitrile, which was added as a polymerization initiator, were put in a 500 ml four-neck separable flask equipped with 3-in-1 motor driver agitation blade, condenser, gas introducing tube and thermometer and stirred at room temperature for 30 minutes under nitrogen airflow to substitute oxygen in the flask with nitrogen. The mixture was then stirred in a hot-water bath of 70° C. at 60 rpm for 6 hours to prepare a graft carbon black.

Next, the mixture of the following composition was dispersed by means of a ball mill for 10 hours. After 1 part by mass each of 2,2'-azobisisobutyronitrile and sodium nitrite were dissolved in the obtained dispersion liquid, 250 parts by mass of 2% by mass solution of polyvinyl alcohol was added and stirred at 8,000 rpm for 10 minutes using TK homomixer by Tokushu Kika Kogyo Co., Ltd. to obtain a suspension liquid.

styrene monomer . . . 50 parts by mass n-butylmethacrylate . . . 14.5 parts by mass 1,3-butanediol dimethacrylate . . . 0.5 parts by mass t-butylacrylamide sulfonate . . . 3 parts by mass low-molecular-weight polyethylene (Mitsui Hi-wax 210P by Mitsui Chemicals, Inc.) . . . 2 parts by mass above graft carbon black . . . 30 parts by mass Next, the obtained suspension liquid was put in a 500 ml four-neck separable flask equipped with 3-in-1 motor driver agitation blade, condenser, gas introducing tube and thermometer and stirred at room temperature under nitrogen airflow to substitute oxygen in the flask with nitrogen. And the mixture was then stirred in a hot-water bath of 70° C. at 100 rpm for 5 to 8 hours to complete polymerization and prepare suspension polymerization particles. Then, 100 parts by mass of the particles were redispersed in a mixed liquid of water and methanol with a mass ratio of 1:1 so as to have a solid content of 30% by mass and after 3 parts by mass of $H_4N(CH_2)_5CH{=}C(C_2F_5)_2$ was added as a charge control agent and stirred, the polymerization particle A was prepared through filtering and drying.

The obtained polymerization particle A was measured as the following and the volume average particle diameter was 5.2 μm and the average shape factor SF1 was 112.

[Measurement of Volume Average Particle Diameter Dt]

The volume average particle diameter was measured by means of a Coulter counter. Examples of the measuring equipment for particle size distribution of the toner particles by Coulter counter method include Coulter counter multisizer and Coulter multisizer IIe (both of which are manufactured by Beckman Coulter, Inc.). The measurement method will be described below.

First, 0.1 ml to 5 ml of surfactant (alkylbenzene sulfonate) is added to 100 ml to 150 ml of electrolytic solution as dispersant. The electrolytic solution is a prepared NaCl solution of approximately 1% by mass using primary sodium chloride and examples include ISOTON-II manufactured by Beckman Coulter, Inc. The measurement sample is further added in the amount of 2 mg to 20 mg. The electrolytic solution in which the sample is suspended is subject to dispersion treatment for approximately 1 minute to 3 minutes using an ultrasonic distributor and the volume and number of toner particles or toner are measured by means of the above measuring equipment, employing an aperture of 100 μm to calculate volume and number distributions. The volume average particle diameter of the toner can be obtained from the obtained distributions.

13 channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm and 32.00 μm to less than 40.30 μm are used and particles having a particle diameter of 2.00 μm or more and/or less than 40.30 μm are surveyed. The particle diameter of each channel used are 2.24 μm; 2.83 μm; 3.56 μm; 4.49 μm; 5.66 μm; 7.13 μm; 8.98 μm; 11.31 μm; 14.25 μm; 17.96 μm; 22.63 μm; 28.51 μm; and 35.92 μm respectively.

[Measurement of Average Shape Factor SF1]

The average shape factor SF1 was calculated from the following Mathematical Formula 1 after attaching the toner on an observation substrate for electronic microscope, coating the observation substrate on which the toner is attached with gold, observing the toner by means of a scanning electronic microscope (S-4500 manufactured by Hitachi, Ltd.) and importing the image of toner into a personal computer to obtain the project area and maximum length of the toner using an image-editing software (Image-Pro Plus manufactured by Media Cybernetics). SF1 of 100 or more numbers of toner was measured to obtain an average SF1.

$$SF1=100\times(\text{maximum length})^2\times\pi/(\text{area}\times 4)$$ <Mathematical Formula 1>

Next, hydrophobized silica A having an average particle diameter of 120 nm was subject to unraveling (stirring by mixer, etc.) and combined so as to be 4% by mass based on the above polymerization particle A, and was subject to stir mixing while stirring intensity was increased in stages (the rotation frequency was increased in stages from 500 rpm to 2,000 rpm) using a Henschel mixer to prepare a toner A.

[Measurement of External Additive Coverage]

The coverage of external additives was obtained by calculating the percentage of an area where the external additives were attached relative to the surface area of the toner, after attaching the toner A on an observation substrate for electronic microscope, coating the observation substrate on which the toner A was attached with gold, observing the toner A by means of a scanning electronic microscope (S-4500 manufactured by Hitachi, Ltd.) and importing the image of toner into a personal computer to measure the area where the external additives were attached using an image-editing software (Image-Pro Plus manufactured by Media Cybernetics). The coverage of external additives is expressed by an average of 10 toners. For the toner A of Example 1, external additives were uniformly attached to the surface of the toner base particles, differences in coverage between toners were small and the average coverage of external additives for the toner A was 19.3%.

The average particle diameter Da of external additives was obtained by measuring the particle diameter of each external additive attached to the toner surface at the time of measuring the coverage of external additives.

—Preparation of Developer—

The two-component developer of Example 1 was prepared by mixing the toner A and carrier A (the carrier used for Imagio Color 4000 manufactured by Ricoh Company, Ltd.) in a way so that the ratio of toner A becomes 5% by mass.

<Preparation of Latent Electrostatic Image Bearing Member (Photoconductor)>

—Formation of Charge Generating Layer—

After 0.4 parts by mass of bisazo pigment expressed by the following Structural Formula (A) was subject to ball milling with 4 parts by mass of tetrahydrofran solution containing 5% by mass of butyral resin (SLEC BL-S manufactured by Sekisui Chemical Co., Ltd.) and 7.6 parts by mass of tetrahydrofran, the mixture was diluted to 2% by mass solution with additional tetrahydrofran to prepare a coating liquid for charge generating layer.

The obtained coating liquid for charge generating layer was applied on an aluminum drum A of 90 mm diameter of which the surface has been roughened by cutting, using a dipping method and dried to form a charge generating layer of 1 μm thickness.

Structural Formula (A)

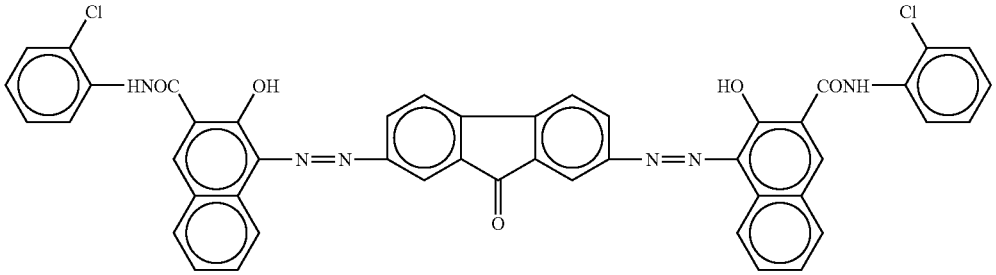

—Formation of Charge Transport Layer—

Next, 6.0 parts by mass of hole transporting substance expressed by the following Structural Formula (B) and 9.0 parts by mass of cyclohexylidene bisphenol polycarbonate (Z Polyca manufactured by Teijin Chemicals Ltd.) as photoconductor binder resin were dissolved in 67 parts by mass of tetrahydrofran to prepare a coating liquid for charge transport layer.

The obtained coating liquid for charge transport layer was applied on the charge generating layer by dipping method and dried to form a charge transport layer of 20 μm thickness.

The photoconductor drum of Example 1 was prepared with the above procedures. The surface profile of the obtained photoconductor drum of Example 1 was measured by means of stylus type surface profiler (DEKTAK manufactured by Ulvac, Inc.) and as a result, the average cycle of surface roughness was 470 μm, which is about 90 times as much of the volume average particle diameter of the toner, 5.2 μm.

Structural Formula (B)

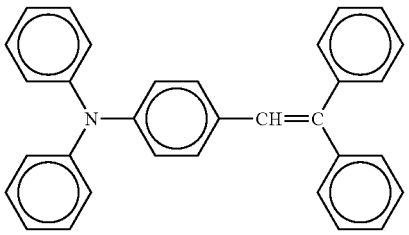

<Measurement of Nonelectrostatic Adhesion and F/(Dt×Da)>

Next, nonelectrostatic adhesion between toner A and photoconductor of Example 1 was measured employing centrifugal method.

First, a circular disc of 7 mm diameter was carved out from the photoconductor drum of Example 1 and attached on a sample substrate of 8 mm diameter used for centrifugation with an adhesion bond. The uncharged toner A was attached on the photoconductor by compressed air and nonelectrostatic adhesion F between the toner and photoconductor was measured using centrifugal method to obtain F/(Dt×Da). Meanwhile, apparatuses and the measurement condition employed for the measurement of nonelectrostatic adhesion are as follow.

[Apparatus and Measurement Condition]

Centrifugation apparatus: CP100α manufactured by Hitachi Koki Co., Ltd. (maximum rotation frequency: 100,000 rpm, maximum acceleration: 800,000 g)

Rotor: Angle Rotor P100AT manufactured by Hitachi Koki Co., Ltd.

Image processor: Image hyper II manufactured by DigiMo

Sample substrate and receiving substrate: a circular disc having a diameter of 8 mm and a thickness of 1.5 mm made of aluminum Spacer: a ring having an outer diameter of 8 mm, inner diameter of 5.2 mm and a thickness of 1 mm made of aluminum Holding member: a circular cylinder having a diameter of 13 mm and length of 59 mm made of aluminum Distance from the center axis of the rotor to the bonding surface of the toner on the sample substrate: 64.5 mm Predetermined rotation frequency f: 1,000 rpm, 1,600 rpm, 2,200 rpm, 2,700 rpm, 3,200 rpm, 5,000 rpm, 7,100 rpm, 8,700 rpm, 10,000 rpm, 15,800 rpm, 22,400 rpm, 31,600 rpm, 50,000 rpm, 70,700 rpm, 86,600 rpm, 100,000 rpm <Image Formation>

The measurement of transfer ratio in primary transferring and evaluation of images with hollow defects were conducted after copying an initial image after changing a developer and performing a continuous copying of 50,000 sheets using the developer and the photoconductor of Example 1 and a color copier (Imagio Color 4000 manufactured by Ricoh Company, Ltd.).

Meanwhile, images are developed by two-component developing method and transferred by using an intermediate transfer belt in the color copier (Imagio Color 4000 manufactured by Ricoh Company, Ltd.). The color copier (Imagio Color 4000 manufactured by Ricoh Company, Ltd.) was reconstructed in a way so that the image forming process can be stopped at a random timing by external signals. And the lubricant coating mechanism which works on the photoconductor drum was removed.

—Measurement of Transfer Ratio—

A solid image was developed on the photoconductor drum and the image forming process was stopped halfway in the primary transferring and the photoconductor drum unit and transfer belt unit were taken out from the copier. The toner mass $(M/A)_{pc}$ per unit area developed on the photoconductor and the toner mass $(M/A)_T$ per unit area transferred on the transfer belt were measured by suck in method and the transfer ratio was obtained from the following Mathematical Formula 5. In suck in method, the toner attached to the photoconductor, etc. is sucked in by means of a vacuum pump, etc., the mass M of the sucked-in toner is measured and the transfer ratio is obtained from the sucked-in area A of the toner.

$$\text{Transfer Ratio}=100\times(M/A)_T/(M/A)_{PC} \quad \text{<Mathematical Formula 5>}$$

—Image Evaluation—

In the image evaluation, occurrence status of images with hollow defects, in which a part of the image is missing, and graininess were evaluated using a single-colored image, in which characters and pictures were mixed. The four-stage evaluation samples for hollow defects and graininess were provided, the image was observed with eyes and by means of CCD microscope camera (Hypermicroscope manufactured by Keyence Corp.) and evaluated with the following four stages by comparing with the evaluation samples.

[Evaluation Standards]

4: cause no problems

3: cause virtually no problems

2: cause problems to a certain degree

1: cause problems

<Result>

The resulted value of F/(Dt×Da) for Example 1 was $6.13\times10^4$ (N/m$^2$), the evaluation of hollow defects and graininess of initial and after continuous copying of 50,000 sheets when using the developer and the photoconductor of Example 1 was 4, the initial transfer ratio was 97.5% and the transfer ratio after continuous copying of 50,000 sheets was 95.4% and appropriate images were obtained stably even after long-term use. The results are shown in Tables 1 and 2.

Example 2

A toner B was prepared by stir mixing using a Henschel mixer as similar to Example 1, except for combining hydrophobized silica A of 120 nm average particle diameter in a way so that it becomes 7% by mass relative to the polymerization particle A.

Moreover, external additive coverage was measured similarly to Example 1 and the average of external additive coverage of toner B was 31%.

Next, the two-component developer of Example 2 was prepared by mixing the toner B and carrier A (the carrier used for Imagio Color 4000 manufactured by Ricoh Company, Ltd.) in a way so that the ratio of toner B becomes 5% by mass.

Moreover, nonelectrostatic adhesion and transfer ratio were measured and the image was evaluated similarly to Example 1.

The resulted value of F/(Dt×Da) for Example 2 was $5.25\times10^4$ (N/m$^2$), the evaluation of hollow defects and graininess of initial and after continuous copying of 50,000 sheets when using the developer and the photoconductor of Example 2 was 4, the initial transfer ratio was 98.3% and the transfer ratio after continuous copying of 50,000 sheets was 96.8% and appropriate images were obtained stably even after long-term use. The results are shown in Tables 1 and 2.

Example 3

A toner C was prepared by stir mixing using a Henschel mixer as similar to Example 1, except for combining hydrophobized silica B of 200 nm average particle diameter in a way so that it becomes 8% by mass relative to the polymerization particle A.

The external additive coverage was measured similarly to Example 1 and the average of external additive coverage was 17.2%. The two-component developer of Example 3 was prepared by mixing the toner C and carrier A (the carrier used for Imagio Color 4000 manufactured by Ricoh Company, Ltd.) in a way so that the ratio of toner C becomes 5% by mass.

Next, nonelectrostatic adhesion and transfer ratio were measured and the image was evaluated similarly to Example 1. As a result, the resulted value of F/(Dt×Da) for Example 3 was $5.95\times10^4$ (N/m$^2$), the evaluation of hollow defects and graininess of initial and after continuous copying of 50,000 sheets when using the developer of Example 3 and the photoconductor of Example 1 was 4, the initial transfer ratio was 97.1% and the transfer ratio after continuous copying of 50,000 sheets was 95.9% and appropriate images were obtained stably even after long-term use. The results are shown in Tables 1 and 2.

Example 4

A toner D was prepared by stir mixing using a Henschel mixer as similar to Example 1, except for combining hydrophobized silica A of 120 nm average particle diameter in a way so that it becomes 3% by mass relative to the polymerization particle A.

The external additive coverage was measured similarly to Example 1 and the average of external additive coverage of toner D was 15.3%.

Next, a toner E was prepared by combining hydrophobized silica C of 14 nm average particle diameter with the toner D in a way so that the amount of the silica C becomes 1% by mass relative to the toner amount and stir mixing by a Henschel mixer.

Next, the two-component developer of Example 4 was prepared by mixing the toner E and carrier A (the carrier used for Imagio Color 4000 manufactured by Ricoh Company, Ltd.) in a way so that the ratio of toner E becomes 5% by mass.

Moreover, nonelectrostatic adhesion and transfer ratio were measured and the image was evaluated similarly to Example 1. As a result, the resulted value of F/(Dt×Da) for Example 4 was $4.45\times10^4$ (N/m$^2$), the evaluation of hollow defects and graininess of initial and after continuous copying of 50,000 sheets when using the developer of Example 4 and the photoconductor of Example 1 was 4, the initial transfer ratio was 98.9% and the transfer ratio after continuous copying of 50,000 sheets was 95.8% and appropriate images were obtained stably even after long-term use. The results are shown in Tables 1 and 2.

Comparative Example 1

A toner F was prepared by stir mixing using a Henschel mixer as similar to Example 1, except for combining hydrophobized silica A of 120 nm average particle diameter in a way so that it becomes 0.5% by mass relative to the polymerization particle A.

The external additive coverage was measured similarly to Example 1 and the average of external additive coverage of toner F was 3.7%.

Next, the two-component developer of Comparative Example 1 was prepared by mixing the toner F and carrier A (the carrier used for Imagio Color 4000 manufactured by Ricoh Company, Ltd.) in a way so that the ratio of toner F becomes 5% by mass.

Moreover, nonelectrostatic adhesion and transfer ratio were measured and the image was evaluated similarly to Example 1. As a result, the resulted value of F/(Dt×Da) for Comparative Example 1 was $8.13\times10^4$ (N/m$^2$), the evaluation of hollow defects and graininess of initial copying when using the developer of Comparative Example 1 and the photoconductor of Example 1 was 2, the evaluation of hollow defects and graininess after continuous copying of 50,000 sheets was 1, the initial transfer ratio was 91.2% and the transfer ratio after continuous copying of 50,000 sheets was 82.1% and the transfer ratio and image quality were degraded after long-term use. The results are shown in Tables 1 and 2.

Example 5

A polymerization particle B having a volume average particle diameter of 6.7 μm and the average shape factor SF1 of 117 was obtained as similar to Example 1, except for setting the rotation frequency of TK homomixer (manufactured by Tokushu Kika Kogyo Co., Ltd.) to 5,000 rpm in polymerization.

A toner G was prepared by stir mixing using a Henschel mixer as similar to Example 1, except for combining hydrophobized silica A of 120 nm average particle diameter in a way so that it becomes 3.5% by mass relative to the obtained polymerization particle B.

The external additive coverage was measured similarly to Example 1 and the average of external additive coverage of toner G was 22.4%.

Next, the two-component developer of Example 5 was prepared by mixing the toner G and carrier A (the carrier used for Imagio Color 4000 manufactured by Ricoh Company, Ltd.) in a way so that the ratio of toner G becomes 5% by mass.

Moreover, nonelectrostatic adhesion and transfer ratio were measured and the image was evaluated similarly to Example 1. As a result, the resulted value of F/(Dt×Da) for Example 5 was $5.54\times10^4$ (N/m$^2$), the evaluation of hollow defects and graininess of initial and after continuous copying of 50,000 sheets when using the developer of Example 5 and the photoconductor of Example 1 was 4, the initial transfer ratio was 97.9% and the transfer ratio after continuous copying of 50,000 sheets was 96.1% and appropriate images were obtained stably even after long-term use. The results are shown in Tables 1 and 2.

Example 6

A toner H was prepared by stir mixing using a Henschel mixer as similar to Example 5, except for combining hydrophobized silica A of 120 nm average particle diameter in a way so that it becomes 6.5% by mass relative to the polymerization particle B.

The external additive coverage was measured similarly to Example 1 and the average of external additive coverage of toner H was 33.8%.

Next, the two-component developer of Example 6 was prepared by mixing the toner H and carrier A (the carrier used for Imagio Color 4000 manufactured by Ricoh Company, Ltd.) in a way so that the ratio of toner H becomes 5% by mass.

Moreover, nonelectrostatic adhesion and transfer ratio were measured and the image was evaluated similarly to Example 1. As a result, the resulted value of F/(Dt×Da) for Example 6 was $3.73\times10^4$ (N/m$^2$), the evaluation of hollow defects and graininess of initial and after continuous copying of 50,000 sheets when using the developer of Example 6 and the photoconductor of Example 1 was 4, the initial transfer ratio was 98.7% and the transfer ratio after continuous copying of 50,000 sheets was 97.1% and appropriate images were obtained stably even after long-term use. The results are shown in Tables 1 and 2.

Example 7

A toner I was prepared by stir mixing using a Henschel mixer as similar to Example 5, except for combining hydrophobized silica B of 200 nm average particle diameter in a way so that it becomes 9% by mass relative to the polymerization particle B.

The external additive coverage was measured similarly to Example 1 and the average of external additive coverage of toner I was 45.3%.

Next, the two-component developer of Example 7 was prepared by mixing the toner I and carrier A (the carrier used for Imagio Color 4000 manufactured by Ricoh Company, Ltd.) in a way so that the ratio of toner I becomes 5% by mass.

Moreover, nonelectrostatic adhesion and transfer ratio were measured and the image was evaluated similarly to Example 1. As a result, the resulted value of F/(Dt×Da) for Example 7 was $2.86\times10^4$ (N/m$^2$), the evaluation of hollow defects and graininess of initial and after continuous copying of 50,000 sheets when using the developer of Example 7 and the photoconductor of Example 1 was 4, the initial transfer ratio was 99.2% and the transfer ratio after continuous copying of 50,000 sheets was 97.8% and appropriate images were obtained stably even after long-term use. The results are shown in Tables 1 and 2.

Example 8

A polymerization particle C having a volume average particle diameter of 4.2 μm and the average shape factor SF1 of 109 was obtained as similar to Example 1, except for setting the rotation frequency of TK homomixer (manufactured by Tokushu Kika Kogyo Co., Ltd.) to 10,000 rpm in polymerization.

A toner J was prepared by stir mixing using a Henschel mixer as similar to Example 1, except for combining hydrophobized silica A of 120 nm average particle diameter in a way so that it becomes 4.5% by mass relative to the obtained polymerization particle C.

The external additive coverage was measured similarly to Example 1 and the average of external additive coverage of toner J was 17.0%.

Next, the two-component developer of Example 8 was prepared by mixing the toner J and carrier A (the carrier used for Imagio Color 4000 manufactured by Ricoh Company, Ltd.) in a way so that the ratio of toner J becomes 5% by mass.

Moreover, nonelectrostatic adhesion and transfer ratio were measured and the image was evaluated similarly to Example 1. As a result, the resulted value of F/(Dt×Da) for Example 8 was $6.35\times10^4$ (N/m$^2$), the evaluation of hollow defects and graininess of initial and after continuous copying of 50,000 sheets when using the developer of Example 8 and the photoconductor of Example 1 was 4, the initial transfer ratio was 96.8% and the transfer ratio after continuous copying of 50,000 sheets was 94.5% and appropriate images were obtained stably even after long-term use. The results are shown in Tables 1 and 2.

Comparative Example 2

A toner K was prepared by stir mixing using a Henschel mixer as similar to Example 8, except for combining hydrophobized silica A of 120 nm average particle diameter in a way so that it becomes 1% by mass relative to the polymerization particle C.

The external additive coverage was measured similarly to Example 1 and the average of external additive coverage of toner K was 5.3%.

Next, the two-component developer of Comparative Example 2 was prepared by mixing the toner K and carrier A (the carrier used for Imagio Color 4000 manufactured by Ricoh Company, Ltd.) in a way so that the ratio of toner K becomes 5% by mass.

Moreover, nonelectrostatic adhesion and transfer ratio were measured and the image was evaluated similarly to Example 1. As a result, the resulted value of F/(Dt×Da) for Comparative Example 2 was $7.88\times10^4$ (N/m$^2$), the evaluation of hollow defects and graininess of initial copying when using the developer of Comparative Example 2 and the photoconductor of Example 1 was 3, the evaluation of hollow defects and graininess after continuous copying of 50,000 sheets was 2, the initial transfer ratio was 92.6% and the transfer ratio after continuous copying of 50,000 sheets was 85.7% and the transfer ratio and image quality were degraded after long-term use. The results are shown in Tables 1 and 2.

Example 9

The mixture of the following composition was stir mixed well in a Henschel mixer, heat melted at a temperature of 130° C. to 140° C. for 30 minutes using a roll mill and after cooled to room temperature, the obtained kneaded product was roughly pulverized to 1 mm to 2 mm using a hammer mill and then finely pulverized by a jet mill to prepare an infinite-form particle A having a volume average particle diameter of 5.9 μm and average shape factor SF1 of 142.

polyester resin (mass-average molecular weight=250,000) . . . 80 parts by mass styrene-methylmethacrylate copolymer . . . 20 parts by mass rice wax (acid value 15) . . . 5 parts by mass carbon black (#44 manufactured by Mitsubishi Chemical Corp.) . . . 8 parts by mass metallized monoazo dye . . . 3 parts by mass A toner L was prepared by combining 4.0% by mass of hydrophobized silica A of 120 nm average particle diameter with the obtained infinite-form particle A and stir mixing using a Henschel mixer.

The external additive coverage was measured similarly to Example 1 and the average external additive coverage of toner L was 11.0%.

Next, a toner M was prepared by stir mixing using a Henschel mixer similarly to Example 1, except for combining hydrophobized silica C of 14 nm average particle diameter in a way so that it becomes 1% by mass relative to the toner L.

Next, the two-component developer of Example 9 was prepared by mixing the toner M and carrier A (the carrier used for Imagio Color 4000 manufactured by Ricoh Company, Ltd.) in a way so that the ratio of toner M becomes 5% by mass.

Moreover, nonelectrostatic adhesion and transfer ratio were measured and the image was evaluated similarly to Example 1. As a result, the resulted value of F/(Dt×Da) for Example 9 was $5.63\times10^4$ (N/m$^2$), the evaluation of hollow defects and graininess of initial and after continuous copying of 50,000 sheets when using the developer of Example 9 and the photoconductor of Example 1 was 4, the initial transfer ratio was 96.1% and the transfer ratio after continuous copying of 50,000 sheets was 94.1% and appropriate images were obtained stably even after long-term use. The results are shown in Tables 1 and 2.

Comparative Example 3

A toner N was prepared by stir mixing using a Henschel mixer as similar to Example 9, except for combining hydrophobized silica A of 120 nm average particle diameter in a way so that it becomes 1.2% by mass relative to the infinite-form particle A.

The external additive coverage was measured similarly to Example 1 and the average external additive coverage of toner N was 4.2%.

Next, the two-component developer of Comparative Example 3 was prepared by mixing the toner N and carrier A (the carrier used for Imagio Color 4000 manufactured by Ricoh Company, Ltd.) in a way so that the ratio of toner N becomes 5% by mass.

Moreover, nonelectrostatic adhesion and transfer ratio were measured and the image was evaluated similarly to Example 1. As a result, the resulted value of F/(Dt×Da) for Comparative Example 3 was $8.0\times10^4$ (N/m$^2$), the evaluation of hollow defects and graininess of initial copying when using the developer of Comparative Example 3 and the photoconductor of Example 1 was 2, the evaluation of hollow defects and graininess after continuous copying of 50,000 sheets was 1, the initial transfer ratio was 87.8% and the transfer ratio after continuous copying of 50,000 sheets was 78.2% and the transfer ratio and image quality were degraded after long-term use. The results are shown in Tables 1 and 2.

Example 10

The photoconductor drum of Example 10 was prepared similarly to Example 1, except for using another aluminum drum B, of which the condition of surface roughening by cutting is changed, instead of using the photoconductor of Example 1.

The surface profile of the photoconductor drum of Example 10 was measured by means of stylus type surface profiler (DEKTAK manufactured by Ulvac, Inc.) similarly to Example 1 and as a result, the average cycle of surface irregularity was 47 μm, which is about 9 times as much of the volume average particle diameter of the toner A, 5.2 μm.

The measurement of nonelectrostatic adhesion and transfer ratio, and the image evaluation were conducted similarly to Example 1 by using the toner A, two-component developer of Example 1 and the photoconductor of Example 10.

The resulted value of F/(Dt×Da) of Example 10 was $6.28\times10^4$ (N/m$^2$), evaluation of hollow defects of initial and after continuous copying of 50,000 sheets when using the developer of Example 1 and the photoconductor of Example 10 was 4, the evaluation of graininess was 3, initial transfer ratio was 97.9%, transfer ratio after continuous copying of 50,000 sheets was 96.3% and appropriate images were obtained stably even after long-term use. The results are shown in Tables 1 and 2.

Example 11

The photoconductor drum of Example 11 was prepared similarly to Example 1, except for using another aluminum drum C, of which the condition of surface roughening by cutting is changed, instead of using the photoconductor of Example 1.

The surface profile of the photoconductor drum of Example 11 was measured by means of stylus type surface profiler (DEKTAK manufactured by Ulvac, Inc.) similarly to Example 1 and as a result, the average cycle of surface irregularity was 27 μm, which is about 4 times as much of the volume average particle diameter of the toner G, 6.7 μm.

The measurement of nonelectrostatic adhesion and transfer ratio, and the image evaluation were conducted similarly to Example 1 by using the toner G, two-component developer of Example 5 and the photoconductor of Example 11.

The resulted value of F/(Dt×Da) of Example 11 was $5.67\times10^4$ ($N/m^2$), evaluation of hollow defects of initial and after continuous copying of 50,000 sheets when using the developer of Example 5 and the photoconductor of Example 11 was 4, the evaluation of graininess was 3, initial transfer ratio was 97.4%, transfer ratio after continuous copying of 50,000 sheets was 95.9% and appropriate images were obtained stably even after long-term use. The results are shown in Tables 1 and 2.

TABLE 2-continued

| | Hollow Defects | | Graininess | | Transfer Ratio (%) | |
|---|---|---|---|---|---|---|
| | Initial | After 50,000 Sheets | Initial | After 50,000 Sheets | Initial | After 50,000 Sheets |
| Comp. Ex. 1 | 2 | 1 | 2 | 1 | 91.2 | 82.1 |
| Comp. Ex. 2 | 3 | 2 | 3 | 2 | 92.6 | 85.7 |
| Comp. Ex. 3 | 2 | 1 | 2 | 1 | 87.8 | 78.2 |

The image forming apparatus and the image forming method of the present invention are capable of obtaining appropriate images stably even after long-term use with high transfer efficiency and no image defects such as hollow defects, and are widely applicable for various copiers, full-color image forming apparatuses such as full-color electrostatic copiers and full-color laser beam printers, electrostatic recording and electrostatic printing, etc.

What is claimed is:

1. An image forming apparatus comprising:

a latent electrostatic image bearing member;

a latent electrostatic image forming unit configured to form a latent electrostatic image on the latent electrostatic image bearing member;

TABLE 1

| | Volume Particle Diameter Dt of Toner (μm) | Average Particle Diameter Da of External Additives of Large Particle Diameter (nm) | F/(Dt × Da) ($N/m^2$) | Coverage of External Additives of Large Particle Diameter (%) | Surface Factor SF1 | Irregularity Cycle of Photoconductor (μm) |
|---|---|---|---|---|---|---|
| Example 1 | 5.2 | 120 | $6.13\times10^4$ | 19.3 | 112 | 470 |
| Example 2 | 5.2 | 120 | $5.25\times10^4$ | 31.0 | 112 | 470 |
| Example 3 | 5.2 | 200 | $5.95\times10^4$ | 17.2 | 112 | 470 |
| Example 4 | 5.2 | 120 | $4.45\times10^4$ | 15.3 | 112 | 470 |
| Example 5 | 6.7 | 120 | $5.54\times10^4$ | 22.4 | 117 | 470 |
| Example 6 | 6.7 | 120 | $3.73\times10^4$ | 33.8 | 117 | 470 |
| Example 7 | 6.7 | 200 | $2.86\times10^4$ | 45.3 | 117 | 470 |
| Example 8 | 4.2 | 120 | $6.35\times10^4$ | 17.0 | 109 | 470 |
| Example 9 | 5.9 | 120 | $5.63\times10^4$ | 11.0 | 142 | 470 |
| Example 10 | 5.2 | 120 | $6.28\times10^4$ | 19.3 | 112 | 47 |
| Example 11 | 5.2 | 120 | $5.67\times10^4$ | 22.4 | 112 | 27 |
| Comp. Ex. 1 | 5.2 | 120 | $8.13\times10^4$ | 3.7 | 112 | 470 |
| Comp. Ex. 2 | 4.2 | 120 | $7.88\times10^4$ | 5.3 | 109 | 470 |
| Comp. Ex. 3 | 5.9 | 120 | $8.0\times10^4$ | 4.2 | 142 | 470 |

TABLE 2

| | Hollow Defects | | Graininess | | Transfer Ratio (%) | |
|---|---|---|---|---|---|---|
| | Initial | After 50,000 Sheets | Initial | After 50,000 Sheets | Initial | After 50,000 Sheets |
| Example 1 | 4 | 4 | 4 | 4 | 97.5 | 95.4 |
| Example 2 | 4 | 4 | 4 | 4 | 98.3 | 96.8 |
| Example 3 | 4 | 4 | 4 | 4 | 97.1 | 95.9 |
| Example 4 | 4 | 4 | 4 | 4 | 98.9 | 95.8 |
| Example 5 | 4 | 4 | 4 | 4 | 97.9 | 96.1 |
| Example 6 | 4 | 4 | 4 | 4 | 98.7 | 97.1 |
| Example 7 | 4 | 4 | 4 | 4 | 99.2 | 97.8 |
| Example 8 | 4 | 4 | 4 | 4 | 96.8 | 94.5 |
| Example 9 | 4 | 4 | 4 | 4 | 96.1 | 94.1 |
| Example 10 | 4 | 4 | 3 | 3 | 97.9 | 96.3 |
| Example 11 | 4 | 4 | 3 | 3 | 97.4 | 95.9 |

a developing unit configured to develop the latent electrostatic image using a toner to form a toner image; and a transferring unit configured to transfer the toner image on a recording medium, wherein a surface of the toner is coated with an external additive comprising fine particles having an average particle diameter Da of 120 nm to 300 nm;

an average percentage of an area where the external additive is attached relative to the surface area of one toner particle is 5% to 90%; and a value obtained by dividing an average F of non-electrostatic adhesion between the toner and the latent electrostatic image bearing member by a product of volume average particle diameter of the toner Dt and average particle diameter of the external additive Da, [F/(Dt×Da)] is $7.5\times10^4 N/m^2$ or less.

2. The image forming apparatus according to claim 1, wherein the image forming apparatus is a tandem type comprising image forming elements including at least the latent electrostatic image bearing member, the latent electrostatic image forming unit, the developing unit and the transferring unit which are arranged in plural numbers.

3. The image forming apparatus according to claim 1, wherein the transferring unit comprises an intermediate transfer member on which the toner image formed on the latent electrostatic image bearing member is primarily transferred and a secondary transferring unit configured to secondarily transfer the toner image on the intermediate transfer member to a recording medium.

4. The image forming apparatus according to claim 1, wherein the volume average particle diameter of the toner Dt is 2 μm to 7 μm.

5. The image forming apparatus according to claim 1, wherein an average shape factor SF1 of the toner is 100 to 130.

6. The image forming apparatus according to claim 1, wherein the toner is a polymerized toner produced by polymerization.

7. The image forming apparatus according to claim 1, wherein the external additive is at least one selected from hydrophobized silica, hydrophobized titanium and hydrophobized alumina.

8. The image forming apparatus according to claim 1, wherein an average cycle of surface irregularity of the latent electrostatic image bearing member Sm and the volume average particle diameter of the toner Dt satisfy the next equation $Sm \geqq 10\ Dt$.

9. An image forming method comprising:

forming a latent electrostatic image on a latent electrostatic image bearing member;

developing the latent electrostatic image using a toner to form a toner image; and transferring the toner image to a recording medium, wherein a surface of the toner is coated with an external additive comprising fine particles having an average particle diameter Da of 120 nm to 300 nm;

an average percentage of an area where the external additive is attached relative to the surface area of one toner particle is 5% to 90%; and a value obtained by dividing an average F of non-electrostatic adhesion between the toner and the latent electrostatic image bearing member by a product of volume average particle diameter of the toner Dt and average particle diameter of the external additive Da, $[F/(Dt \times Da)]$ is $7.5 \times 10^4 N/m^2$ or less.

10. The image forming method according to claim 9, wherein an image forming apparatus, which is a tandem type comprising image forming elements including at least a latent electrostatic image bearing member, a latent electrostatic image forming unit, a developing unit and a transferring unit which are arranged in plural numbers, is used.

11. The image forming method according to claim 9, wherein the transferring comprises an intermediate transfer member on which the toner image formed on the latent electrostatic image bearing member is primarily transferred and a secondary transferring unit configured to secondarily transfer the toner image on the intermediate transfer member to a recording medium.

12. The image forming method according to claim 9, wherein the volume average particle diameter of the toner Dt is 2 μm to 7 μm.

13. The image forming method according to claim 9, wherein an average shape factor SF1 of the toner is 100 to 130.

14. The image forming method according to claim 9, wherein the toner is a polymerized toner produced by polymerization.

15. The image forming method according to claim 9, wherein the external additive is at least one selected from hydrophobized silica, hydrophobized titanium and hydrophobized alumina.

16. The image forming method according to claim 9, wherein an average cycle of surface irregularity of the latent electrostatic image bearing member Sm and the volume average particle diameter of the toner Dt satisfy the next equation $Sm \geqq 10\ Dt$.

* * * * *